US005711484A

United States Patent [19]

Blette et al.

[11] Patent Number: 5,711,484

[45] **Date of Patent: *Jan. 27, 1998**

[54] DISPENSING TUBE FOR DIRECTING THE DISPENSING OF FLUIDS

[75] Inventors: Russell E. Blette, Hastings; John C. Ruta, White Bear Lake; W. Bruce Sandison, St. Louis Park; William W. Stevenson, Lake Elmo, all of Minn.

[73] Assignee: Minnesota Mining and Manufacturing Company, St. Paul, Minn.

[ * ] Notice: The term of this patent shall not extend beyond the expiration date of Pat. No. 5,480,095.

[21] Appl. No.: 562,227

[22] Filed: Nov. 22, 1995

Related U.S. Application Data

[63] Continuation-in-part of Ser. No. 260,527, Jun. 16, 1994, Pat. No. 5,480,095, which is a continuation-in-part of Ser. No. 121,270, Sep. 14, 1993, abandoned.

[51] Int. Cl.[6] ..... B65D 83/14

[52] U.S. Cl. ..... 239/104; 239/337; 239/588; 239/589; 239/591; 222/109; 222/402.1

[58] Field of Search ..... 239/104, 337, 239/463, 466, 500, 501, 588, 589, 591; 222/402.1, 109

[56] References Cited

U.S. PATENT DOCUMENTS

| | | | |
|---|---|---|---|
| 1,411,573 | 4/1922 | McGarrahan . | |
| 1,600,379 | 9/1926 | Werneman . | |
| 2,359,171 | 9/1944 | Tarbox | 239/501 |
| 2,963,228 | 12/1960 | Hait | 239/230 |
| 2,981,482 | 4/1961 | Warren | 239/230 |
| 3,096,002 | 7/1963 | Focht | 239/337 |
| 3,101,876 | 8/1963 | Ayres | 222/394 |
| 3,108,590 | 10/1963 | Gorman | 128/173 |
| 3,191,809 | 6/1965 | Schultz et al. | 222/402.1 |
| 3,246,850 | 4/1966 | Bourke | 239/394 |
| 3,272,403 | 9/1966 | Alexander | 222/394 |
| 3,283,962 | 11/1966 | Whitmore | 222/402.18 |
| 3,617,000 | 11/1971 | Probst et al. | 239/15 |
| 4,401,271 | 8/1983 | Hansen | 239/337 |
| 4,401,272 | 8/1983 | Merton et al. | 239/337 |
| 4,520,951 | 6/1985 | Facey | 222/182 |
| 4,538,920 | 9/1985 | Drake | 366/177 |
| 4,728,007 | 3/1988 | Samuelson et al. | 222/182 |
| 4,817,832 | 4/1989 | Nagy | 222/530 |
| 4,850,517 | 7/1989 | Ter Stege | 222/402.18 |
| 4,977,950 | 12/1990 | Muench | 239/466 |
| 5,004,128 | 4/1991 | Richichi et al. | 222/527 |
| 5,029,738 | 7/1991 | Dillon | 222/527 |
| 5,100,320 | 3/1992 | Martin et al. | 433/90 |
| 5,139,201 | 8/1992 | De Laforcade | 239/343 |
| 5,193,746 | 3/1993 | Iwamura et al. | 239/104 |
| 5,193,748 | 3/1993 | Wittersheim et al. | 239/337 |
| 5,199,500 | 4/1993 | Norman et al. | 239/104 |
| 5,287,998 | 2/1994 | Smrt | 239/337 |
| 5,480,095 | 1/1996 | Stevenson et al. | 239/104 |
| 5,538,188 | 7/1996 | Simonette | 239/591 |

FOREIGN PATENT DOCUMENTS

| | | | |
|---|---|---|---|
| 0 505 630 | 9/1992 | European Pat. Off. | B26B 21/44 |
| 2-214555 | 8/1990 | Japan | B65D 83/14 |
| 598923 | 3/1948 | United Kingdom . | |
| 2 186 916 | 8/1987 | United Kingdom | B65D 83/14 |
| 2 198 189 | 6/1988 | United Kingdom | B65D 83/14 |

OTHER PUBLICATIONS

Johnsen, "The Aerosol Handbook," 2nd Edition, Wayne Dorland Company Sep. 12, 1983.
"Valves, Sprayheads & Accessories," pp. 17–30, Newman–Green, Inc. (no date).
Sequist Valve Catalog (Jan. 1987).
Summit Packaging Systems, Inc. (no date).
Valois of America Catalog (particularly items 251–321 and 251–331, p. 21) (no date).
Lindal, Aerosol–Valves (no date).

*Primary Examiner*—Andres Kashnikow
*Assistant Examiner*—Lisa Ann Douglas
*Attorney, Agent, or Firm*—Leland D. Schultz

[57] ABSTRACT

A fluid dispensing tube with fluid deflection surface that attenuates accumulation of solidified sprayed fluid. The fluid deflection surfaces can be used for mechanically breaking-up a fluid to enhance sprayability and uniformity or to create a fan spray, or both. The inlet end of the fluid dispensing tube can be fluidly connected to a container of fluid.

33 Claims, 16 Drawing Sheets

DISPENSING TUBE FOR DIRECTING THE DISPENSING OF FLUIDS

This is a continuation-in-part of Ser. No. 08/260,527 filed Jun. 16, 1994 (now U.S. Pat. No. 5,480,095), which is a continuation-in-part of Ser. No. 08/121,270 filed Sep. 14, 1993, now abandoned.

FIELD OF THE INVENTION

This present invention relates to dispensing tubes for directing the dispensing of fluids from containers.

BACKGROUND OF THE INVENTION

Containers have been known in the art for dispensing fluids under pressure. The fluid may be expelled in the form of an aerosol spray, that is, in fine droplets. For the purposes of this invention, the term "aerosol" means "suspensions or dispersions of fine solid or liquid particles, foams, syrups, or powders in a gas." Alternatively, the fluid may be expelled in the form of a stream of liquid, rather than in an aerosol spray.

An example of one such device is shown in FIG. 1. The container 10 includes a container body, or can 12 that typically is cylindrical and hollow, and includes reservoir 14 for receipt of a quantity of a fluid 16. The cavity 14 is enclosed on its bottom end by bottom closure 18, and on its upper end by top closure 20. As illustrated in FIG. 1, top closure 20 includes a first top closure portion **20*a*, and a second top closure portion 20*b*. Access opening 22 is formed in the upper closure 20 communicating with reservoir 14 for egress of the fluid 16** from the container.

One conventional dispensing system expels fluid from the container by means of a pump or like mechanism placed in communication with the fluid within a reservoir. In this case it is not necessary to place the fluid under pressure while in storage within the container. The following is a nonexclusive list of commercially available pump mechanisms for expelling a fluid from a container: Seamist and Euromist II Brand pumps available from Seaquist Dispensing, Division of Aptar Group of Cary, Ill., or with a Precision Aeropump Brand pump available from the Precision Valve Corporation of Yonkers, N.Y.

Frequently however, a dispensing system is utilized in which the fluid 16 in the reservoir is subject to pressure sufficient to expel the pressurized fluid through the access opening 22, to the exterior of the container body 12. Therefore, all of the components of the container forming the body 12 are constructed from materials, such as metallic materials, that may be effectively sealed in fluid tight relationship and withstand the pressure applied when filled with a fluid to be dispensed.

Such fluids 16 may include a mixture of a first fluid, such as indicated at 16 in FIG. 1, to be expelled from the container and a second fluid or phase, such as propellant 17, contained under pressure (such as in the head space 24 between the fluid 16 and the upper closure 20). It is this type of conventional spray container that is shown in FIGS. 1–3A and will be discussed herein in greater detail.

Referring now in particular to FIGS. 1 and 1A, spray head assembly 24 is mounted on the container 12 to control the dispensing of the fluid 16 from the container. Spray head assembly 24 includes actuator or push button 26. As illustrated in FIG. 1, actuator 26 includes stem 28, slidingly received in fluid tight relationship within access opening 22, and a top surface 30 adapted for convenient manual engagement.

Actuator 26 includes passageway 32 that extends from a first end 34, through stem 28 and the actuator body, to a second end 36. At least one slot 29 is formed in the stem adjacent to the first end 34 and communicating with passageway 32. The number, width and length of the slots may be selected to regulate the flow of fluid through the actuator.

The second end 36 includes a nozzle portion 38 mounted at second end 36 of passageway 32, terminating in orifice 40 of reduced diameter to meter the flow of fluid therethrough. The stem 28 is connected to a valve 39 mounted within the container body. Valve 39 may be of any suitable design for controlling the flow of fluid from the reservoir 14.

Gasket 41 is mounted between valve 39 and upper closure **20*b*. Stem 28 is slidingly received with aperture 41*a* and sealed by gasket 41. Valve seat 42 is mounted within cavity 43 of the valve and is in contact with the end of stem 28. Spring 45 is mounted in cavity 43 of the valve and is in contact with valve seat 42. Spring 45 urges valve seat 42 in direction 46 to a closed, sealed position wherein the valve seat 42 seals against gasket 41, supported by top closure 20*b*. Slot 29 is located below gasket 41 to contain the fluid. If the actuator 26 is shifted in direction 48 against the force of spring 45, the valve is opened and fluid is able to flow past the valve seat 42 through slot 29 to the actuator passageway 32**.

The type of actuator illustrated is "female" type. A "male" type of actuator (not shown) would include a tubular projection from the valve that would be received within a cooperative cavity in the actuator. However for purpose of this invention, the term "actuator" will be understood to include both male and female actuators, unless otherwise indicated.

The spray head assembly 30 also includes a tube 50 that provides fluid communication between first end 34 of the passageway 32 and the distal portion of the reservoir 14, and the fluid contained therein. Tube 50 includes passageway 54, extending to a second end 60 adjacent to the bottom of the reservoir 14. Valve 39 includes a passageway 52 that extends from passageway 54 of tube 50 to cavity 43.

When valve seat 42 is shifted to the open position, fluid 16 is propelled by the pressure of the vapor phase of propellant 17, acting in direction 64, into second end 60 of the tube 56, through the tube, through passageway 54 of tube 50, passageway 52 and cavity 43 of valve 39, through passageway 32 of actuator 26 outwardly from the container.

As shown more particularly in FIG. 2, passageway 32 includes two contiguous segments **32*a* and 32*b*. Segment 32*a* extends from first end 34 through passageway 32 and is generally axially aligned (along axis 66) therewith. Segment 32*b* projects from segment 32*a* along axis 68 and determines the direction of the fluid dispersion from the actuator. The segments 32*a* and 32*b* form elbow 70** at their juncture.

In the past, it has been common to provide a propellant such as a liquefied gas, that is a volatile organic compound, dissolved, dispersed or otherwise co-mixed with the compound with the fluid 16 being a material that is dissolved in the compound. It has also been known that when dispensed, a portion of the fluid 16 has a tendency to be deposited on surface within the spray head assembly and then solidify through evaporation of the solvent and propellant. By "solidified" it is meant that the deposits are solid, semi-solid or viscous layers in which the material from the fluid is highly concentrated. These solidified deposits tend to accumulate at any obstruction or sharp change in geometry in the passageway through which the fluid is conveyed (as at 72 in FIGS. 3 and 3A). Such locations in conventional spray head assemblies are formed at elbow 70 of passageway 32, at the end of stem 28 engaged with valve 39, and the interior side of the nozzle member about the orifice, all shown in FIGS. 3 and 3A. In addition, it has been observed that the fluid also tends to fall back, solidify and accumulate on the exterior of the actuator body about the orifice 40, as shown in FIGS. 3 and 3A.

Although undesirable, this accumulation of solidified material has not presented a significant problem in the past. When the dispensing of the fluid with a volatile organic compound based solvent and propellant were resumed, the compound contained in the newly ejected fluid stream redissolved or redispersed the accumulated material and thus prevented substantial interference with, or blockage of, the operation of the container.

More recently, concern over environmental effects of the use of volatile organic compounds has made the use of other solvents, such as water, more desirable. It has been observed however, that water dissolvable and/or dispersable fluids that accumulate within the passageway 32 or above the actuator are generally not redispersed or redissolved when dispensing of the fluid is resumed. The accumulation shown in FIGS. 3 and 3A continues to increase to the point where significant restriction of the passageway, or even outright blockage, occurs with clear detrimental effect on the operation of the container.

The viscosity of water dissolvable and/or dispersable fluids may influence accumulation of solids in the passageways, as well as the uniformity and sprayability of the fluid. A lower viscosity fluid results in less internal pressure in the nozzle during spraying, and generally less mechanical break-up of the fluid into an aerosol spray. Where the viscosity is low (about 250–1000 centipoise), the fluid tends to exit the nozzle in a stream, rather than as an aerosol spray. One approach to achieving adequate mechanical break-up is to reduce the size of the outlet end of the spray nozzle orifice. A small diameter orifice, however, can be difficult to manufacture and is generally more prone to clogging when spraying water dissolvable and/or dispersable fluids.

The viscosity of water dissolvable and/or dispersable fluids may vary for a number of reasons. For example, adhesives that permit repositioning of the adhered article generally have a lower solids content, and therefore a lower viscosity. Additionally, water dissolvable and/or dispersable fluids may need to be formulated with certain freeze-thaw characteristics to facilitate transport and storage. If the fluid is exposed to low temperatures, the water in the fluid may crystallize, causing the solids to coalesce. When thawed, the solids do not necessarily return to their uncoalesced state. One approach to achieving a low freezing point is to use dimethylether (DME) as a propellant, which tends to lower the viscosity. However, DME is a volatile organic compound that contributes to the harmful environmental effects sought to be avoided by water dissolvable and/or dispersable fluids.

Consequently, when spraying low viscosity fluids, it may be necessary to mechanically break-up the fluid stream to achieve the desired level of atomization, sprayability and uniformity, without causing the accumulation of solidified material within the passageway of the actuator. Mechanical break-up of the fluid stream may also be desirable to achieve a finer spray pattern and a more even distribution of the fluid.

In order to achieve faster and/or wider coverage, it is sometimes desirable to expel the liquid from the nozzle in an oval or fan spray configuration, rather than a circular spray configuration. Solidified material may accumulate on some mechanisms used to create the fan spray configuration, resulting in potential blockage of the dispenser assembly.

Thus, it is desirable to provide a dispenser that mechanically breaks-up water dissolvable and/or dispersable fluids, without accumulating solids in or on the dispenser. It is also desirable to create a fan spray pattern without the accumulation of solids in the dispenser, particularly with water based fluids.

SUMMARY OF THE INVENTION

The present invention relates to a dispensing tube that directs the dispensing of fluids. In one embodiment, the dispensing tube directs the fluid in a fan spray configuration. In an alternate embodiment, the dispensing tube directs the fluid into a turbulent flow to enhance mechanical break-up.

The dispensing tube defines a passageway smoothly extending in a smooth curvilinear manner from an inlet end to an outlet end for conveying a fluid from the inlet end to the outlet end thereof while attenuating accumulation of solidified material from the fluid within the passageway and on an external surface of the dispensing tube proximate the outlet end. A fluid deflection surface is integrally formed in the dispensing tube in smooth fluid communication with the passageway for directing the dispensing of a fluid, while attenuating the accumulation of solidified material from the fluid on the fluid deflection surface. The inlet end of the dispensing tube may be connected to a source of the fluid and a mechanism for propelling the fluid through the passageway.

In one embodiment, the fluid deflection surface is formed proximate the outlet end of the dispensing tube for directing the fluid to produce a non-circular spray pattern. The non-circular pattern may be oval or some irregular shape. In another embodiment, a pair of opposing deflection surfaces formed on the external surface of the dispensing tube adjacent to the outlet end directs the fluid into a fan spray configuration. In a preferred embodiment, the fluid deflection surface directs the dispensing of a fluid in a non-circular spray pattern with an aspect ratio of between 3:1 to 8:1.

In another embodiment, the fluid deflection surface is a shaped trough cut in the outlet end of the dispensing tube intersecting and generally perpendicular to an axis defined by the passageway. The shaped trough extends through the external surface of the dispensing tube. The shaped trough directs the dispensing fluid to produce a non-circular spray pattern. The trough may be V-shaped, U-shaped, rectangular, circular or a variety of other shapes.

In an alternate embodiment, the fluid deflection surface is at least one raised surface on an interior surface of the passageway for directing the fluid into a turbulent flow. The turbulent flow results in increased mechanical break-up of the fluid so that the fluid is expelled in a generally uniform distribution with a finer pattern, even for low viscosity fluids. The at least one raised surface may be a spiral configuration or a plurality of protrusions. In one embodiment, the passageway may be configured with a taper narrowing toward the outlet end of the dispensing tube. The fluid deflection surface for producing a non-circular spray pattern may be combined with the fluid deflection surfaces for producing mechanical break-up of the fluid.

The present invention is also directed to a system in which the dispensing tube is in fluid communication with a container having a reservoir for receipt of a quantity of the fluid. A mechanism for propelling the fluid from the reservoir through the passageway in the dispensing tube is provided. A quantity of fluid is located in the reservoir of the container for dispensing through the dispensing tube.

As used herein, "directing" means the dispensing of fluid to produce a particular spray pattern or a more turbulent flow.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE INVENTION

Figure 1:
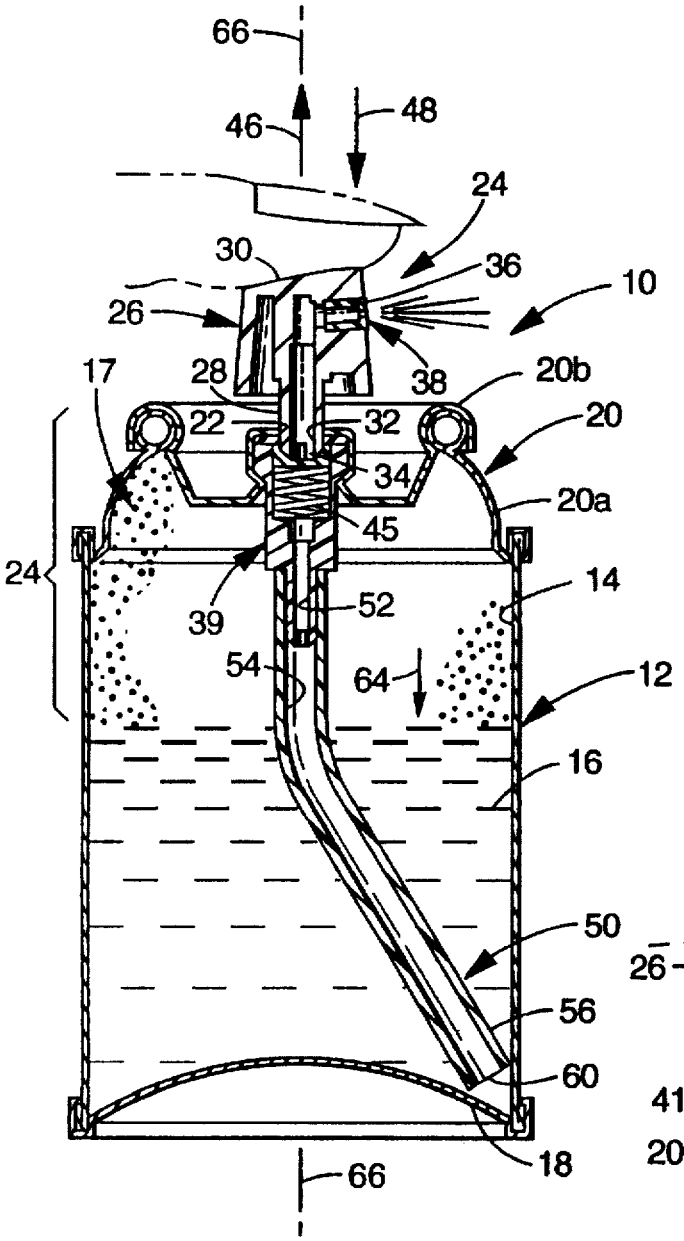
Fig. 1 PRIOR ART
FIG. 1 is a cross-sectional view of an aerosol spray applicator with a conventional actuator.
Figure 1A:
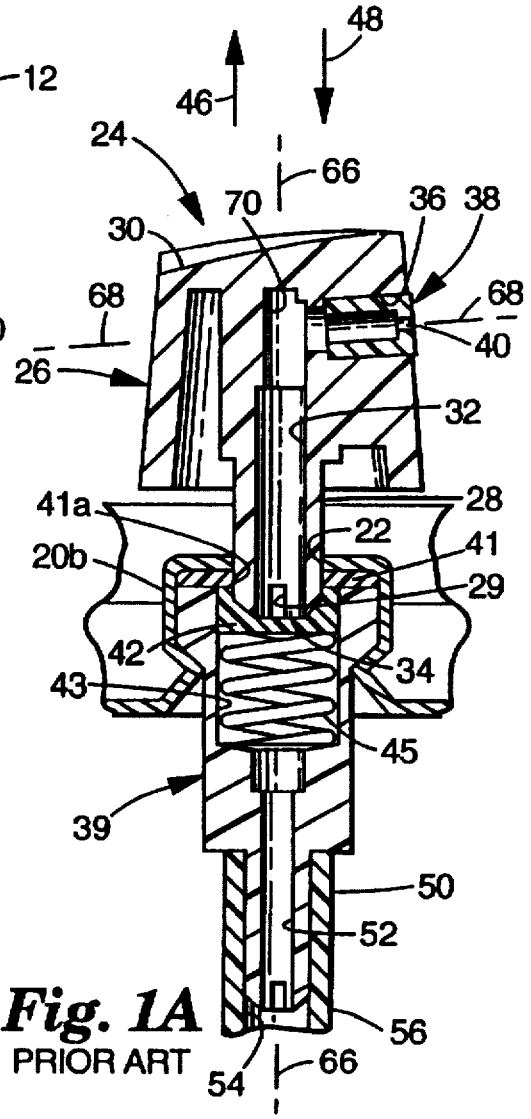
Fig. 1A PRIOR ART
FIG. 1A is a magnified partial view of the spray head assembly of the aerosol spray applicator of FIG. 1.
Figure 2:
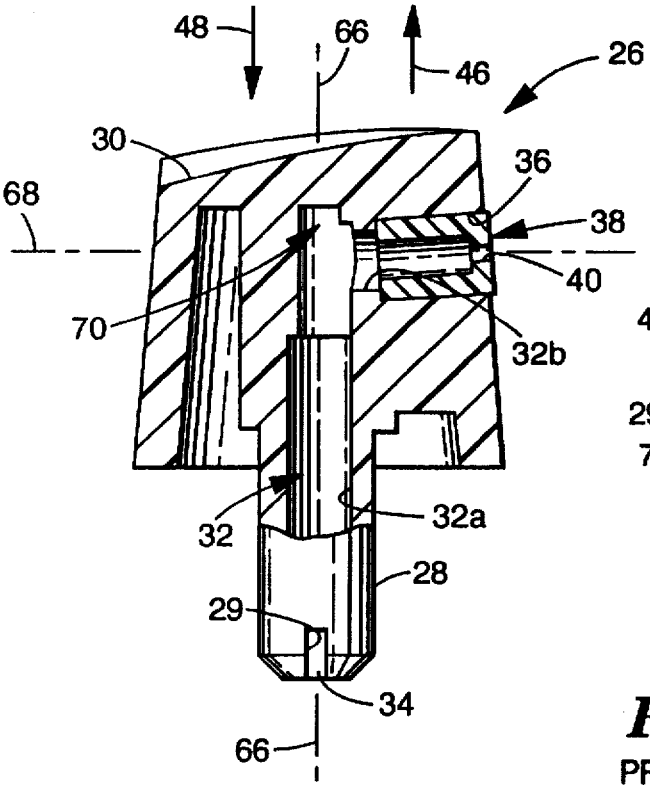
Fig. 2 PRIOR ART
FIG. 2 is a magnified cross-sectional view of the conventional actuator of FIG. 1.
Figure 3:
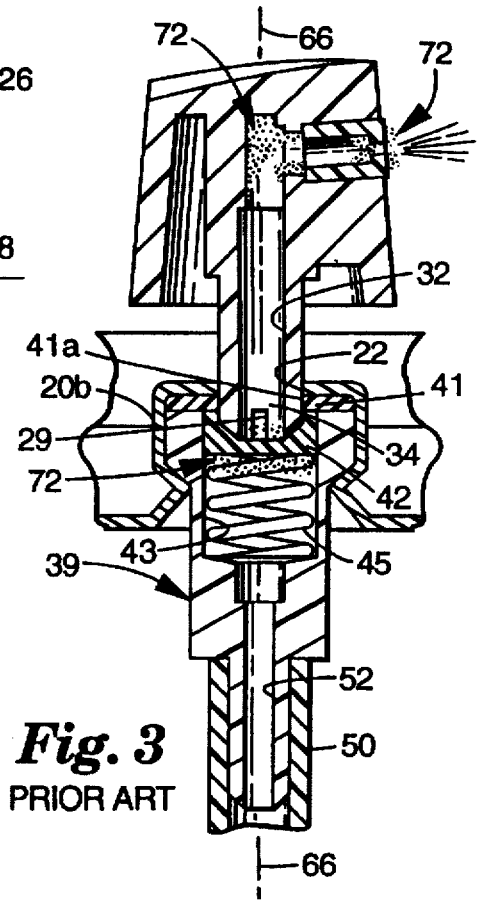
Fig. 3 PRIOR ART
FIG. 3 is a magnified partial cross-sectional view of a portion of the conventional actuator of FIG. 2 dispensing a fluid.
Figure 3A:
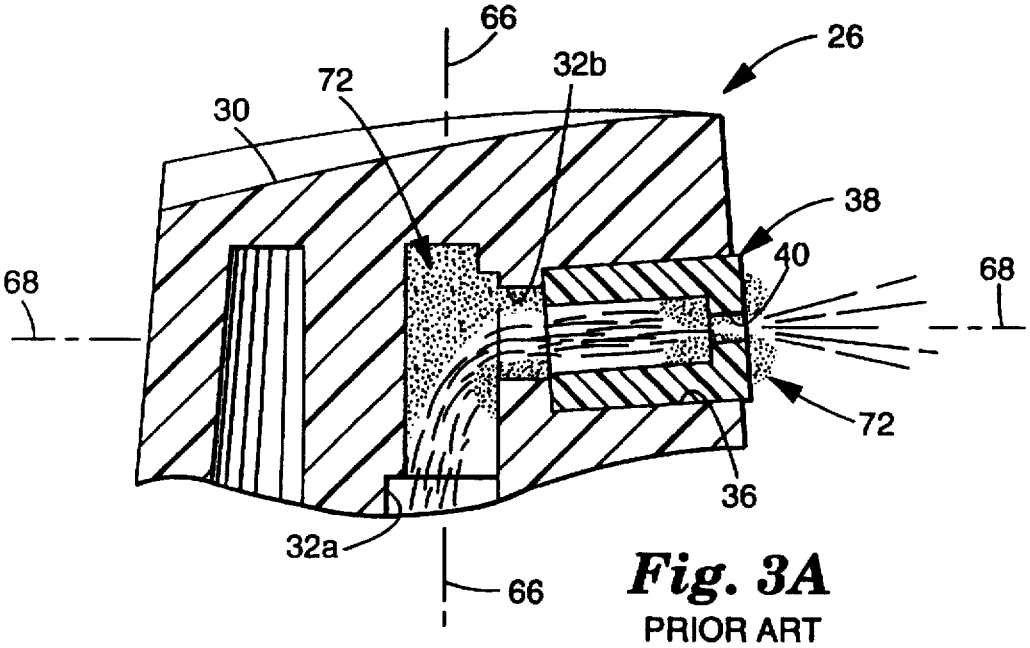
Fig. 3A PRIOR ART
FIG. 3A is a magnified partial view of the spray head assembly of the conventional aerosol spray applicator of FIG. 3 dispensing a fluid.

Referring now to FIGS. 4, 5A, 5B, 5C, 5D and 6, there is illustrated an actuator 100 according to the present invention. Although not illustrated, the present invention also encompasses actuator 100, such as the embodiment of the invention shown in FIGS. 5A, 5B, 5C, 5D and 6, connected to a tube 50, such as shown in FIG. 1, to form a spray head assembly and further may be operatively connected to a container 12 filled with a fluid. Preferably, the container is an aerosol spray container and the fluid is stored under pressure, such as previously described with respect to FIGS. 1–3A. For purposes of this invention, the term "fluid" includes any and all liquids, gases, particulate solids, or like flowable materials capable of being expelled under pressure in conjunction with the present invention. The following is a nonexclusive list of exemplary commercially available three piece tin-plate aerosol containers that may be employed for use with the present invention: 202X406 (6 fluid ounces); 202X509 (8 fluid ounces); 211X604 (16 fluid ounces); and 300X709 (24 fluid ounces), three piece tin-plate all available from Crown Cork and Seal Company of Philadelphia, Pa. and United States Can Company of Elgin, Ill., and 50 mm by 190 mm (336 cc); 59 mm by 185 mm (447 cc); 66 mm by 235 mm (708 cc), one piece aluminum construction, all available from EXAL Corporation of Youngstown, Ohio, and Advanced Monobloc Corporation of Hermitage, Pa.

The following is a nonexclusive list of fluids, including water based and hydrocarbon based adhesives, hydrocarbon based propellants and hydrocarbon based solvents that may be employed with the actuator and aerosol spray container of the present invention:

CONCENTRATES

1. Solvents

Hexane, Cyclohexane, Heptane, Toluene, Methyl Ethyl Ketone, Ethanol, Water, Pentane, 1,1,1-Trichloroethane.

2. Adhesives

Styrene Butadiene, Acrylic, Neoprene, Nitrile, Block Polymers, Block co-polymers.

PROPELLANTS

Butane, Butene, Isobutane, Propane, Dimethyl Ether, Difluoroethane, Carbon Dioxide, Nitrogen, air.

It is to be understood that the actuator of the present invention may be employed with other fluid dispensers, such as those employing pumps (not shown) or those dispensing the fluid in a stream, rather than as droplets in an aerosol spray.

In the present invention, the actuator 100 is adapted to attenuate the accumulation of solidified fluid material 16 within the actuator, even with water based fluids. For purposes of this invention, the term "attenuate" includes the prevention, reduction or elimination of solidified material from the fluid being dispensed within the fluid dispensing container of the present invention. For purposes of this invention, the term "solidified" material includes solid, semisolid or viscous bodies of material concentrated from the fluid.

Figure 4:
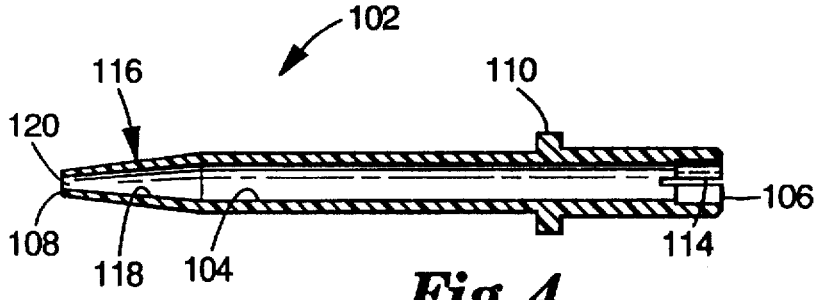
FIG. 4 is a cross sectional view of a dispensing tube according to the present invention for use with an actuator.

In the embodiment illustrated in FIGS. 5A, 5B, 5C, 5D and 6, this is accomplished by providing, as part of the actuator 100, a dispensing tube 102 (shown in more detail in FIG. 4). The following is a nonexclusive list of materials from which dispensing tube 102 may be constructed for use in the present invention: polyethylene, high density polyethylene, polypropylene, polyacetal, polystyrene, polytetrafluoroethylene, and nylon. Alternatively, a smoothly deflectable dispensing tube may be constructed of any suitable material and the walls of the passageway coated or lined with a desired material, such as silicone or polytetrafluoroethylene.

The dispensing tube 102 forms passageway 104 therewithin, and extends between first end 106 and second end 108. Annular ring 110 projects from the tube at an intermediate location. First end 106 includes one or more axial slots 114, sized and located to control the flow of the fluid therethrough from the aerosol container cavity, when operatively connected thereto, as previously explained. The second end 108 of the dispensing tube includes nozzle portion 116 for controlling and directing the flow of fluid from the dispensing tube.

Although the dispensing tube 102 may be provided with a constant inner diameter throughout its length, in the preferred embodiment of the invention, the nozzle portion 116 includes an inner frusto-conical chamber 118 terminating in an orifice 120. In this arrangement the frusto-conical chamber 118 progressively directs the fluid being ejected into a more laminar and coherent flow, thus providing a more controlled and uniform dispersion or spray pattern.

One method (not illustrated) of producing the dispensing tube 102 of the present invention with a frusto-conical chamber in the nozzle portion, includes heating a thermoplastic tube (not shown) at an intermediate location and then pulling ends of the tube in opposite directions. This induces a "necking" or narrowing of the tube at the heated section. The tube may then be divided at the "necked" portion to create two dispensing tubes having the inner frusto-conical chambers in the nozzle portions. Of course, the dispensing tube may be produced by any other suitable process, such as injection molding, or sacrificial molding.

In the embodiment of the present invention shown in FIGS. 5A–D and 6, actuator 100 includes a body 122 that defines a receptacle 124 therethrough for receipt of the dispensing tube through first opening 128, with a portion of the dispensing tube adjacent second end 108 projecting through second opening 130. In the preferred embodiment of the invention, the body 122 is most conveniently constructed by premolding a unitary molded body from a polymeric material. The following is a nonexclusive list of the polymeric materials that may be utilized to construct actuator body 112 in the embodiment of FIGS. 5A–5D: polystyrene, polypropylene, polyethylene, high density polyethylene, polyvinyichloride, polyacetal, and nylon.

Figure 5A:
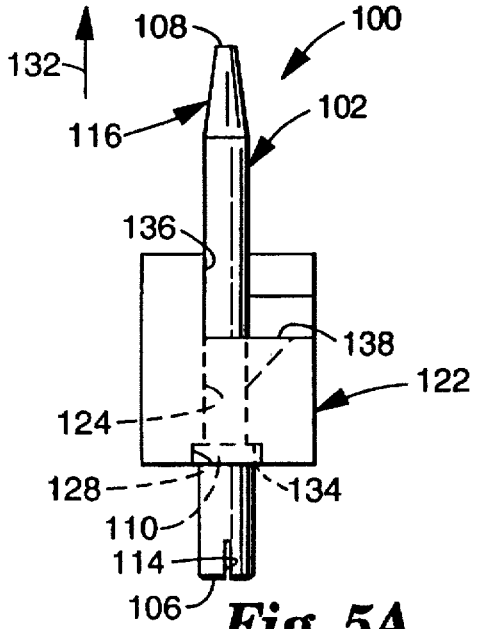
FIG. 5A is a side view of an actuator constructed according to the present invention, with a dispensing tube inserted and in a first position.
Figure 5B:
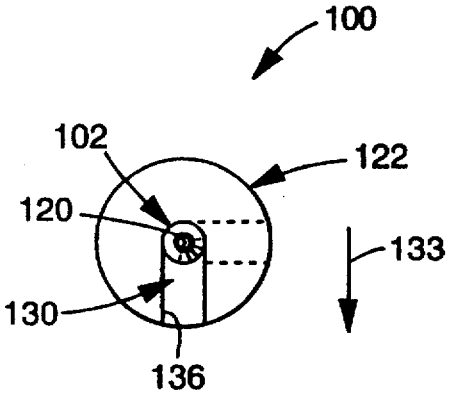
FIG. 5B is a top view of the actuator of FIG. 5A with the dispensing tube in a first position.
Figure 5C:
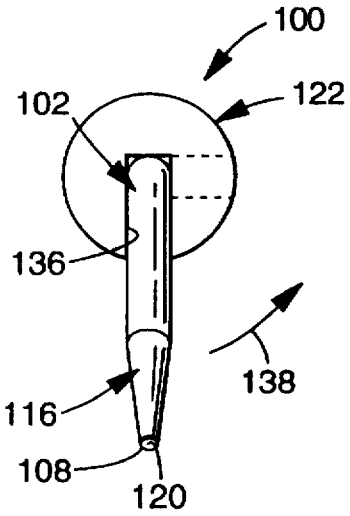
FIG. 5C is a top view of the actuator of FIGS. 5A and 5B, with the dispensing tube deflected to a second position.

Dispensing tube 102 may be inserted in direction 132 through opening 128 through receptacle 124 as shown in FIGS. 5A and 5B. The dispensing tube 102 is positioned within the receptacle of the body 122 by contact between annular ring 110 on the dispensing tube and annular recess 134 formed in the body 122 of the actuator about first opening 128. The dispensing tube 102 is so constructed to enable the portion of the dispensing tube 102 protruding from opening 130 to be deflected in direction 133 as shown in FIG. 5C into slot 136. The deflected portion of the dispensing tube may then be rotated in direction 138 into slot 140, as shown in FIG. 5C, to achieve the position shown in FIGS. 5D and 6. The tube may be secured in place by any suitable means, including but not limited to, mechanical friction, ultrasonic welding, or bonding such as by an adhesive.

The shape and configuration of the receptacle 124 of the actuator body cooperates with the dispensing tube 102 in such a manner as to smoothly deflect the tube from first end 106 to second end 108, and thus smoothly deform the passageway 104 in a curvilinear path. For purposes of this invention, the term "smooth" means to be formed in a manner that is free from irregularities, roughness, indentations, projections, protuberances or any abrupt changes in geometry that provides a location for the accumulation of solidified material. The smooth curvilinear passageway 104 thus eliminates the elbow formed by conventional actuators, wherein the solidified material tends to accumulate.

Figure 5D:
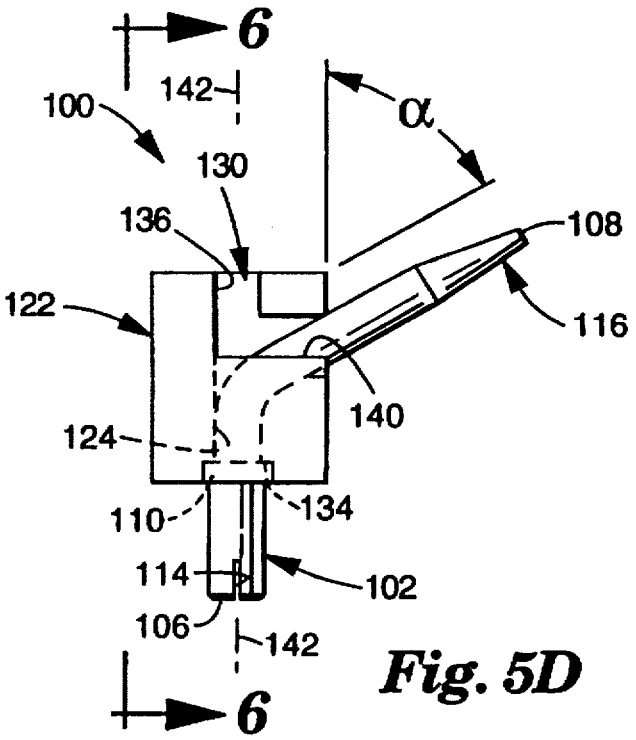
FIG. 5D is a side view of the actuator of FIGS. 5A, 5B, and 5C with the deflected dispensing tube rotated to a third position.
Figure 6:
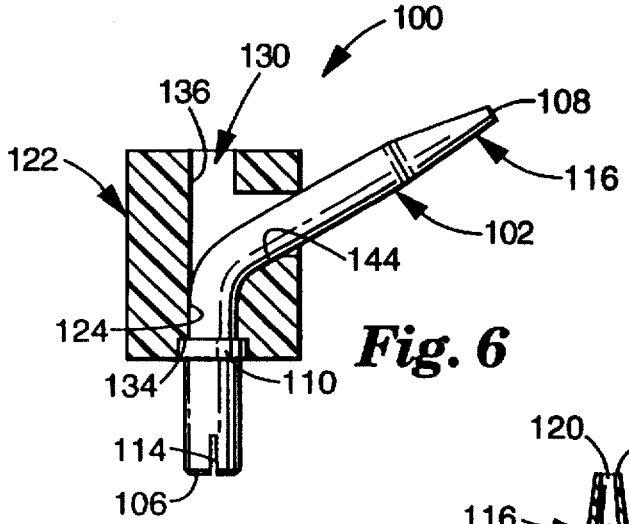
FIG. 6 is a partial cross-sectional view along plane 6—6 of the actuator of FIG. 5D.

In the preferred embodiment of the invention, the dispensing tube extends beyond the actuator body, thus spacing the nozzle portion 116 and orifice 120 therefrom, as shown in FIGS. 5D and 6. By spacing the orifice 120 away from the actuator body 122, the fluid emerging from the orifice is less likely to fall back and accumulate on the exterior of the actuator, or to block the orifice as compared to conventional actuators, such as shown in FIGS. 1–3A. Further, in the preferred embodiment of the invention, the portion of the dispensing tube extending beyond the actuator body, including the nozzle portion, is inclined at an angle with respect to axis 142. This smooth deflection is facilitated by contact between the deflected portion of the dispensing tube and surface 144 (shown in FIG. 6) within the receptacle.

In this manner, any portion of the fluid that solidifies within the inclined frusto-conical chamber 118 of the nozzle portion will tend to fall to the lower surface of the frusto-conical chamber 118 and drain backward through the dispensing tube 102. This contributes to attenuating the accumulation of the solidified material within the frusto-conical chamber 118 and the potential blockage or restriction of the office 120 of the dispensing tube.

In operation, the first end 106 of the dispensing tube 102 forming passageway 104, may be utilized as the stem of the spray head assembly and placed in fluid communication with the reservoir 14 of the container through access opening 22, such as through the conventional valve and tube assembly as in FIG. 1. The actuator may then be operated in the manner hereinabove described with respect to FIGS. 1–3A.

Figure 7:
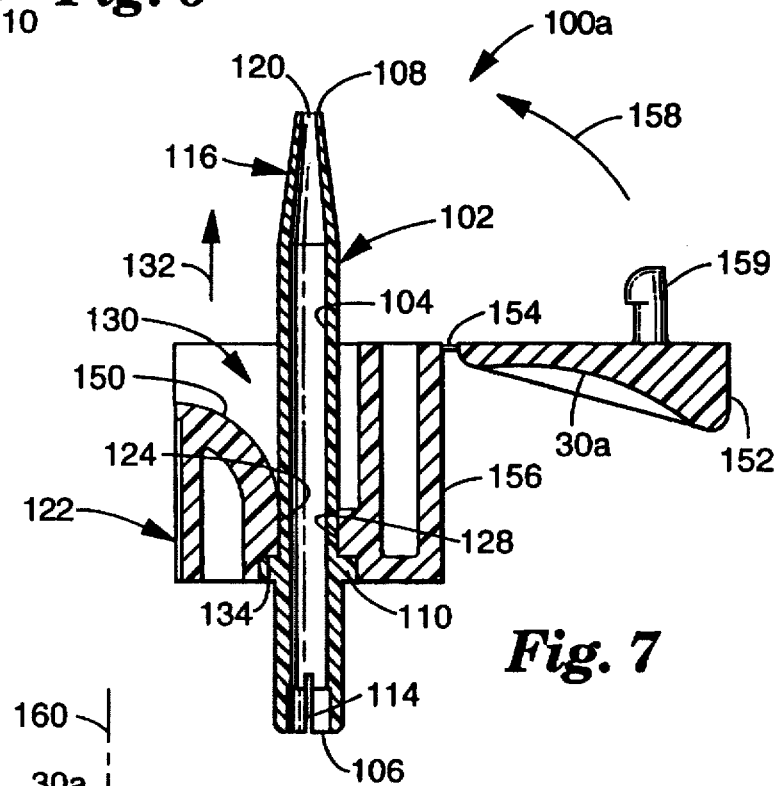
FIG. 7 is a cross-sectional view of an alternate embodiment of the actuator of the present invention with a cap in an open position.
Figure 8:
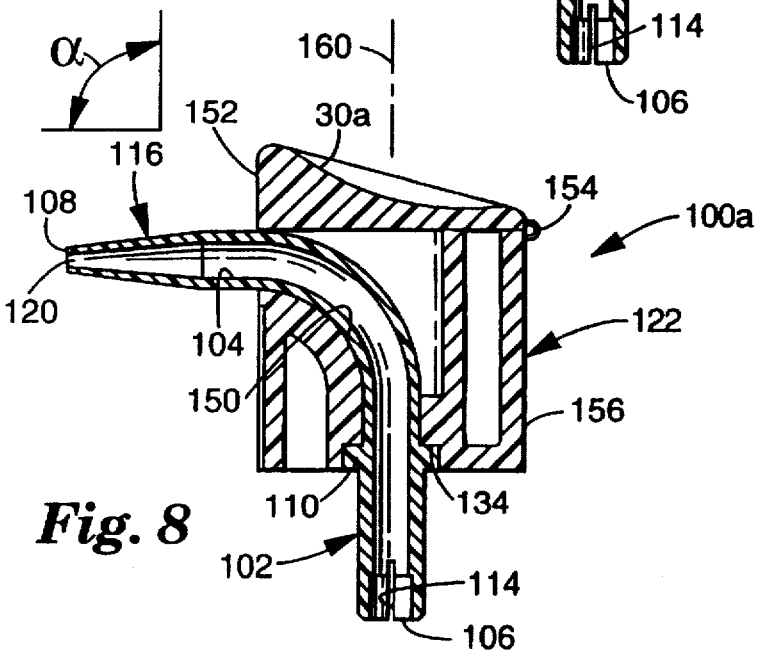
FIG. 8 is a cross-sectional view of the alternate embodiment of the actuator of FIG. 7 with the cap in a closed position.

FIG. 7 illustrates an alternate embodiment 100*a* of the actuator of the present invention. In this embodiment, dispensing tube 102 is inserted in direction 132 through opening 128 into receptacle 124 in the actuator body 122 and projects through opening 130. Receptacle 124 of the actuator includes curvilinear surface 150, corresponding to surface 144 in the embodiment shown in FIG. 6. The actuator body 122 includes a closure or lid 152 hingedly mounted (such as by living hinge 154 in FIG. 7) on the main actuator body portion 156. The "living" hinge enables the actuator lid and main body portion to be molded as a unitary structure, in a manner known in the art. The closure may be rotated in direction 158 to bring the lid 152 in contact with the main actuator body portion 156 as shown in FIG. 8. Contact between the lid 152 and the dispensing tube 102 deflects a portion of the dispensing tube into conformity with the curvilinear surface 150. Once deflected to the position shown in FIG. 8, the dispensing tube 102 follows a smooth curvilinear path from the first end 106 to the second end 108 and thus attenuates the accumulation of solidified material within the passageway 104 as herein described.

Means are provided to secure the lid in the closed position shown in FIG. 8. In the illustrated embodiment, the securing means include one or more tangs 159 projecting from the lid 152 and preferably integrally molded therewith. When the closure is rotated to the closed position in FIG. 8, the tangs 159 engage an aligned indentation or shoulder (not shown) in the main body portion 156 of the actuator to secure the closure in place. Of course, any suitable arrangement may be provided to secure the lid in the closed position. As in the embodiment shown in FIG. 6, the projecting portion of the dispensing tube 102 is thus inclined at an angle $\alpha$, (approximately 90°) with respect to axis 160.

Figure 7A:
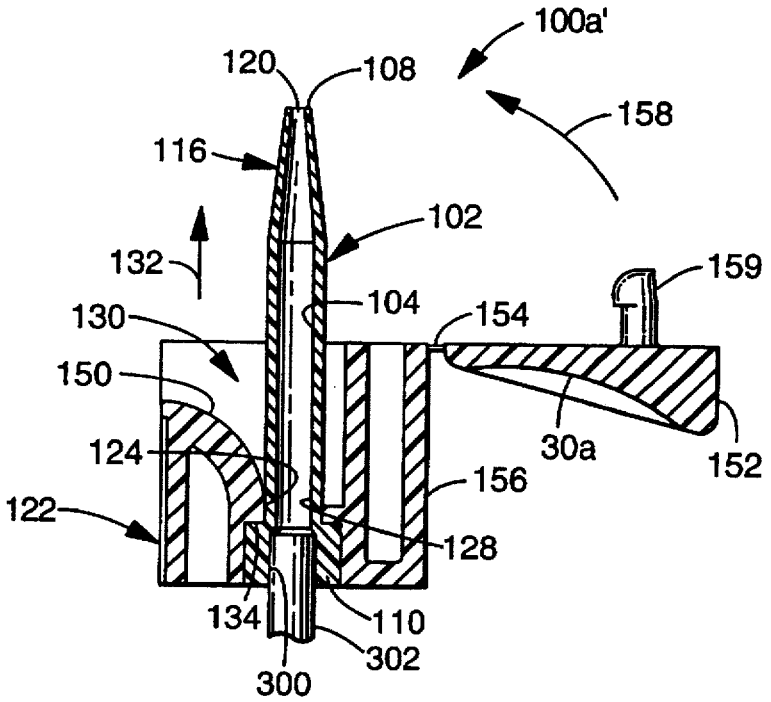
FIG. 7A is a cross-sectional view of the actuator of FIG. 7, modified as a female actuator.

FIG. 7A illustrates a modification 100*a*' of the male actuator embodiment of the present invention shown in FIG. 7, as a female actuator. Cavity 300 is formed in the actuator body communicating with first end 106 of the dispensing tube 102 and with passageway 104. Cavity 300 is adapted to receive in sealing engagement hollow stem 302 extending from a valve (not shown) mounted on a container (similar to the arrangement shown in FIG. 1). In all other respects the embodiment shown in FIG. 7A operates as herein described.

Figure 9:
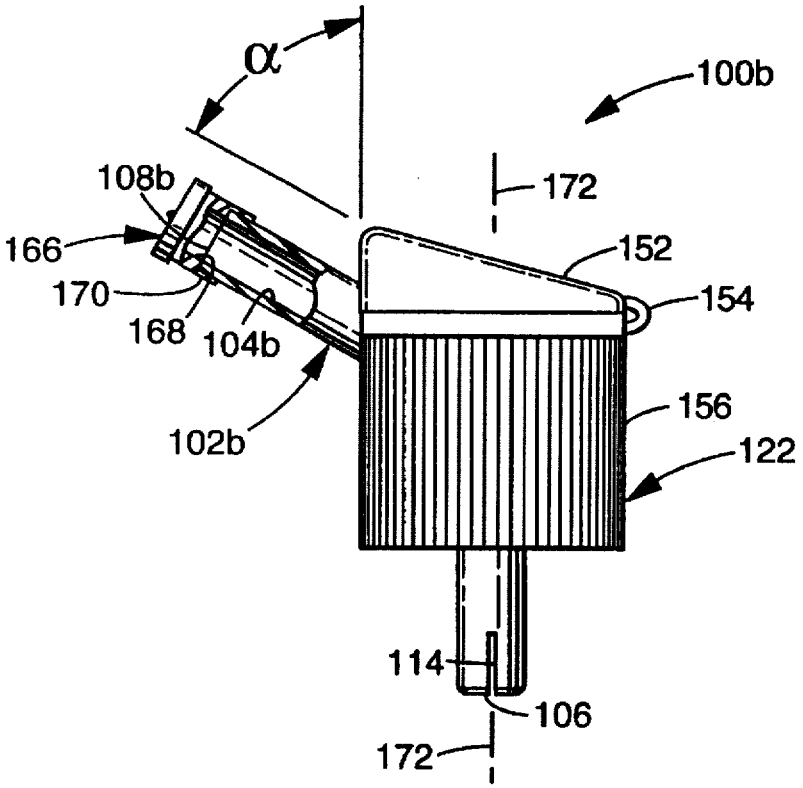
FIG. 9 is a side view of a cap of an alternate embodiment of the spray head assembly of the present invention with an insert mounted on the end of the dispensing tube.
Figure 10:
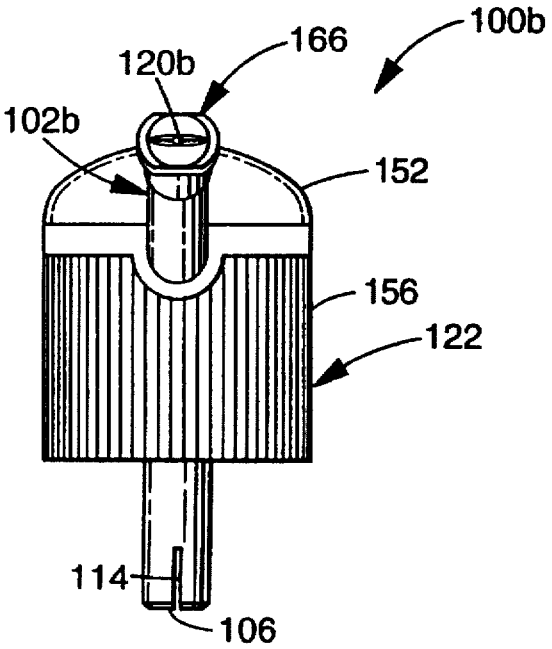
FIG. 10 is a frontal view of the alternate embodiment of the spray head assembly of FIG. 9.
Figure 10A:
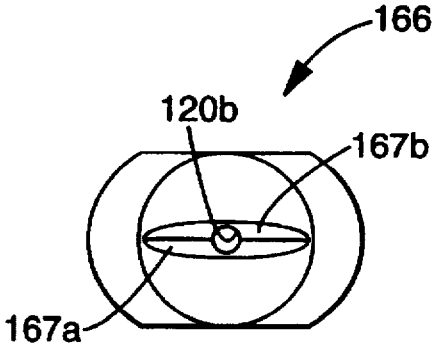
FIG. 10A is a magnified view of the nozzle portion and orifice of FIG. 10.

FIGS. 9, 10 and 10A illustrate another alternate embodiment 100*b* of the present invention. The actuator body 122 is as described with respect to FIGS. 7 and 8. However in place of the nozzle portion having a frusto-conical chamber, the passageway 104*b* of the dispensing tube 102*b* terminates at a second end 108 spaced from the actuator body. An insert nozzle 166 is mounted on the end of the dispensing tube 102*b*. The insert is preferably a unitary molded piece, formed such as from polymeric materials including but not limited to, polyethylene, high density polyethylene, polypropylene, polyacetal, polystyrene and nylon, secured on the dispensing tube about the second end of the passageway by any suitable arrangement such as ultrasonic welding, frictional engagement or by the use of an adhesive.

The insert nozzle 166 includes a conduit 168 communicating with the passageway 104*b* extending through dispensing tube 102*b*. The second end 108*b* of the dispensing tube 102*b* is received within an enlarged portion 170 of the conduit so that there is a smooth transition between the passageway 104*b* and conduit 168, to attenuate the accumulation of solidified material therewithin. As shown more particularly in FIG. 10A, the orifice 120*b* of the insert nozzle 166 is generally circular in cross section with laterally spaced deflection surfaces 167*a* and 167*b*. This produces a spray pattern that is more concentrated and flattened than the spray pattern produced by the circular orifice of the embodiments in FIGS. 4–8.

In the illustrated embodiment, the insert nozzle 166 and the portion of the dispensing tube 102*b* protruding from the actuator body are inclined upward from the horizontal at an angle with respect to axis 172, suitable to drain any solidified material (as defined herein) away from the insert and the orifice to attenuate any blockage of the conduit 168 of the insert nozzle 166 and the projecting position of the dispensing tube 102*b*.

Of course, orifices with any desired size or shape may be provided as part of any embodiment of the present invention to modify and control the spray pattern of the fluid being dispensed in a desired manner. For instance, an orifice having a desired predetermined shape (such as non-circular) may be formed directly on a dispensing tube 102 as shown in FIG. 4.

Figure 11:
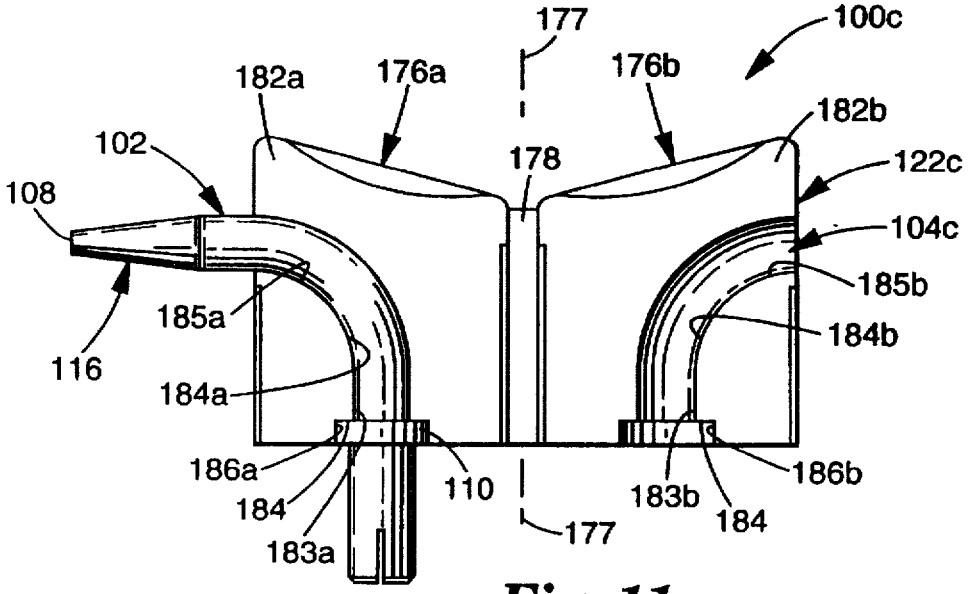
FIG. 11 is a front view of an alternate embodiment of the present invention with bifurcated halves of the actuator body hingedly connected and in an open position.
Figure 12:
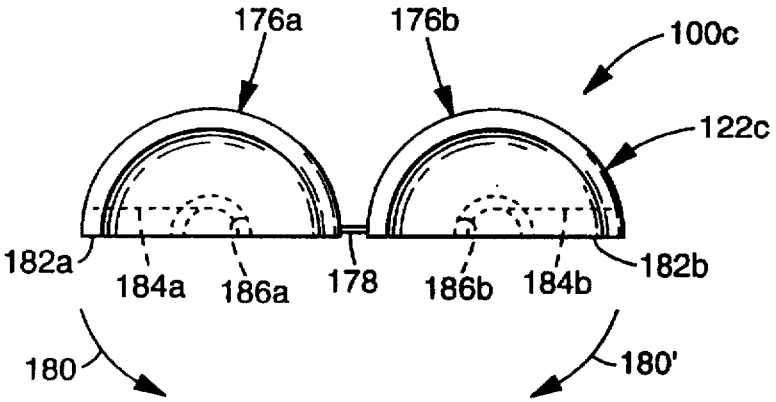
FIG. 12 is a top view of the alternate embodiment of the present invention shown in FIG. 11 without a dispensing tube.
Figure 13:
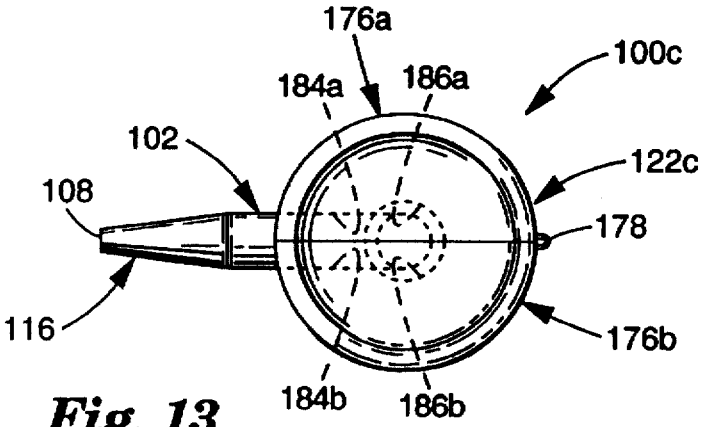
FIG. 13 is a top view of the actuator and dispensing tube of FIG. 11, with the hingedly connected bifurcated halves of the actuator body in a closed position.

FIGS. 11–13 illustrate another alternate embodiment 100*c* of the present invention in which actuator body 122*c* is divided about a plane parallel to axis 177. Preferably, the actuator body is bifurcated into the two segments 176*a* and 176*b*. The segments are rotatively connected along aligned edges parallel to axis 177, such as by living hinge 178. As previously described, the arrangement shown with the living hinge enables the actuator body, including the bifurcated segments, to be molded as a unitary structure in a manner known in the art. The facing surfaces of the bifurcated segments 176*a* and 176*b* may be shifted in opposite rotative directions 180 and 180' between an open position (shown in FIGS. 11 and 12) and a closed position (shown in FIG. 13) with facing surfaces 182*a* and 182*b*, respectively.

The opposing facing surfaces 182*a* and 182*b* of the bifurcated segments 176*a* and 176*b* include aligned grooves 184*a* and 184*b* that cooperate to form passageway 104*c* when the bifurcated segments are brought together in the closed position. Each of the grooves 184a and 184b include a first end 183a and 183b, and a second end 185a and 185b. The grooves extend in a smooth curvilinear manner from their respective first ends to the second ends. Each of the grooves includes portions 186a and 186b adjacent to the respective first ends thereof that are wider in diameter than the remainder of the grooves 184a and 184b, so that annular recess 184 (shown in FIG. 11) is formed when the bifurcated segments are in the closed position (similar to annular recess 134 in the embodiment shown in FIGS. 7 and 8).

Thus, a dispensing tube 102 (as in FIG. 4) may be positioned in one of the grooves 184a, 184b of the bifurcated segments 176a, 176b, and thus smoothly deflected thereby, with annular ring 110 in contact with one of the enlarged portions 186a and 186b. The bifurcated segments may then be shifted to the closed position shown in FIG. 13 to enclose and retain the dispensing tube in the smoothly deflected position. The grooves 184a and 184b have a cross sectional shape suitable for receiving the dispensing tube 102, and preferably the grooves and portions 186a, 186b are semi-cylindrical in cross section to receive a tubular dispensing tube. The bifurcated segments 176a, 176b may be secured in the closed position by any suitable arrangement such as by adhesives, or mechanically such as by tangs, clips, snap closures (not shown), ultrasonic welding, or the like.

Figure 14:
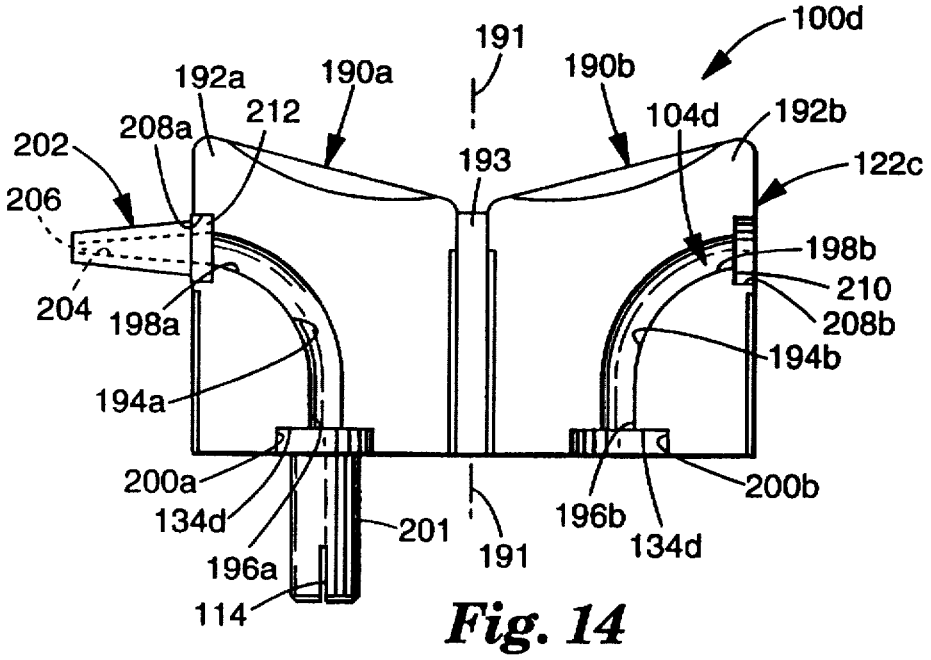
FIG. 14 is a front view of an alternate embodiment of the present invention with bifurcated halves of the actuator body hingedly connected and in an open position.
Figure 15:
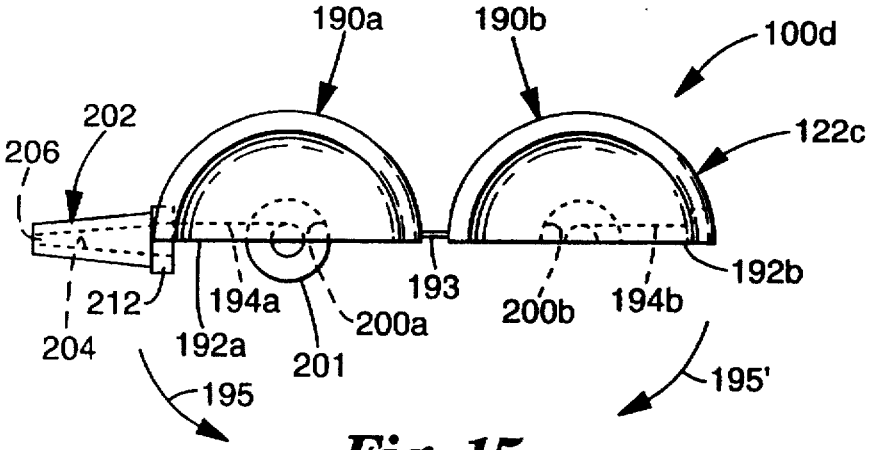
FIG. 15 is a top view of the alternate embodiment of the present invention shown in FIG. 14.
Figure 16:
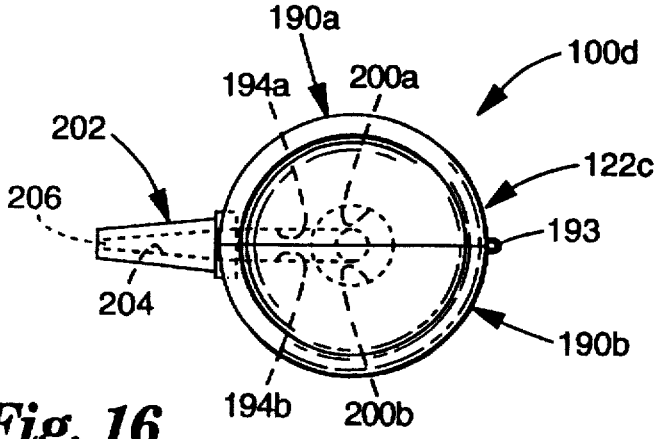
FIG. 16 is a top view of the actuator and dispensing tube of FIG. 14, with the hingeally connected bifurcated halves of the actuator body in a closed position.

FIGS. 14–16 illustrate another alternate embodiment 100d of the present invention in which the actuator is constructed in a manner similar to that in FIGS. 11–13. That is, actuator body 122c is divided parallel to axis 191 into two segments about a vertical plane. Preferably the plane is a medial plane and the segments are bifurcated, symmetrical halves of the actuator body, as illustrated. The segments 190a and 190b are rotatively connected along aligned edges parallel to axis 191, such as by living hinge 193. As previously noted, the living hinge enables the entire actuator body, including the bifurcated segments, to be molded as a unitary structure in a manner known in the art. The facing surfaces 192a, 192b of the bifurcated segments 190a and 190b may be shifted in opposite rotative directions 195, 195' between an open position (shown in FIGS. 14 and 15) and a closed position (shown in FIG. 16).

In the embodiment shown in FIGS. 14–16, the opposing facing surfaces 192a, 192b of the bifurcated segments 190a and 190b include aligned grooves 194a and 194b, that cooperate to form passageway 104d when the bifurcated segments are brought together in the closed position (as shown in FIG. 16). Each of the grooves 194a and 194b include first ends 196a, 196b and second ends 198a, 198b, with the grooves extending in a smooth curvilinear manner from their respective first ends to the second ends. Each of the grooves includes respective portions 200a and 200b adjacent the first ends thereof, that are larger in diameter than the remainder of the grooves, so that annular recess 134d is formed when the bifurcated segments 190a and 190b are in the closed position (similar to annular recess 134 in the embodiment shown in FIGS. 7 and 8). As in the embodiment in FIGS. 7 and 8, suitable means (not shown) may be provided to secure the bifurcated segments in the closed position including, but not limited to, adhesives, mechanical fasteners (such as snap closures), ultrasonic welding, or the like.

However in the embodiment shown in FIGS. 15 and 16, a dispensing tube is not employed. Rather, the grooves 194a, 194b directly and cooperatively form a passageway 104d when the bifurcated halves 190a and 190b are shifted to their closed position, as in FIG. 16. Grooves 194a, 194b, including portions 200a, 200b have a cross section suitable for smoothly conveying the fluid therethrough, and preferably are semicylindrical to form a cylindrical passageway when the segments 190a, 190b are in their closed position. A separate tubular stem member 201 may be mounted into the recess 134d of the passageway. The stem member 201 includes a passageway (not shown) extending from the passageway of the actuator slot 114 to connect the actuator to a conventional valve and fluid container as previously described. The passageway of the stem member 201 has a diameter matched to the diameter of passageway 104d to attenuate the accumulation of solidified material. It is even more preferable to integrally form the stem as part of the actuator body segments, such as by molding, to form the passageway as herein described.

Since a dispensing tube is not provided, a separate nozzle member 202 is provided including a frusto-conical chamber 204 terminating in an orifice 206 for dispensing the fluid therethrough. The second ends 198a, 198b of the grooves 194a and 194b each include portions 208a, 208b of enlarged diameter adjacent thereto. When the bifurcated segments 190a and 190b are in their closed position, an annular recess 210 is formed. The nozzle member 202 includes a first end 212 having a diameter such that it may be inserted into the annular recess 210 of the passageway 104d and retained therein by any suitable means, such as by frictional engagement, adhesives, mechanical fasteners, ultrasonic welding or the like. The inner diameter of the frusto-conical chamber 204 adjacent the first end 212 is sized to closely conform to the inner diameter of the passageway 104d and ensure a smooth transition from the passageway to the frusto-conical chamber and attenuate the accumulation of solidified material at the juncture. It has been known in the past to provide a nozzle member having a frusto-conical chamber such as in place of the nozzle portion 38 shown in FIGS. 1–3A. For instance, nozzle model Nos. 251/321 and 251/331 available from Valois S. A. of Le Neubourg, France provide such nozzle portions. However, such conventional nozzle members having frusto-conical chambers generally include a "land" or a cylindrical portion extending between the frusto-conical chamber and the orifice. It has been found advantageous in the present invention to eliminate the land and terminate the frusto-conical chamber directly at the orifice.

Of course, an actuator (not shown) similar to that shown in FIGS. 14–16 may be constructed from segments that are not hingedly connected, but rather separate members that are secured together, such as by mechanical fasteners, adhesives, ultrasonic welding or any other suitable arrangements.

Figure 17:
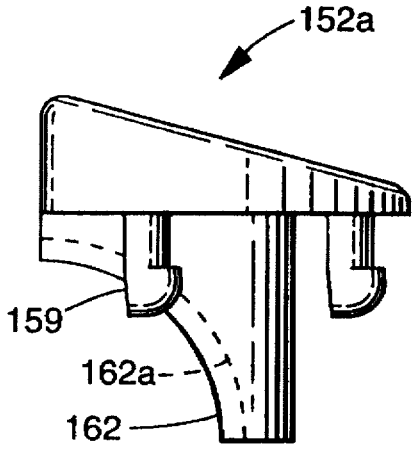
FIG. 17 is a side view of a lid of an alternate embodiment of the present invention.
Figure 18:
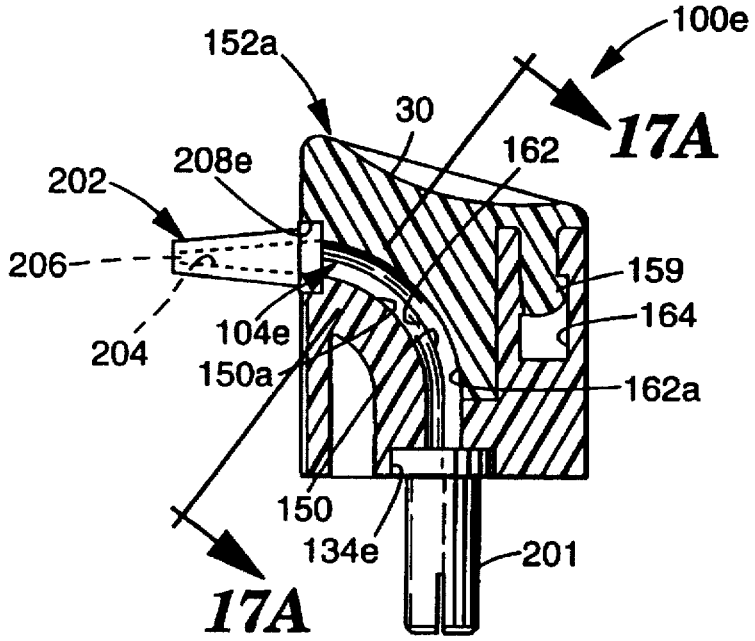
FIG. 18 is a cross sectional side view of the lid of FIG. 17 mounted on a main actuator body to form a passageway.
Figure 17A:
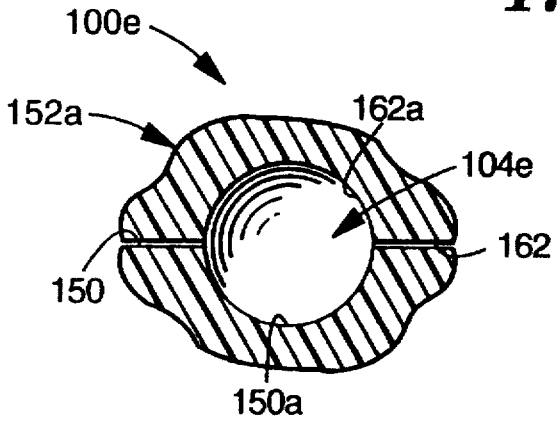
FIG. 17*a* is a magnified cross-sectional view of the passageway extending through the actuator of FIG. 17.

An alternate embodiment 100e of the actuator is illustrated in FIGS. 17, 17A and 18, wherein lid or cap 152a is provided, but not directly connected to main actuator body portion. Lid 152a is provided with a depending curvilinear surface 162 and one or more projecting tangs 159 (two of which are shown in FIG. 17). Lid 152a is held in position by engagement of the tangs with aligned receptacles 164 in the main actuator body portion. The curvilinear surface 162 of the lid 152a is in contact with curvilinear surface 150 of the main actuator body portion. Aligned grooves 150a and 162a are formed in the surfaces 150 and 162, respectively. When the surfaces 150 and 162 are brought into fluid tight contact (as in FIG. 17A), the grooves 150a and 162a cooperate to form a passageway 104e extending smoothly through the actuator body from a first end to a second end, as previously described with respect to FIGS. 14–16. As in the embodiment shown in FIGS. 14–16, a stem member 201 is provided for connecting the actuator to a valve (not shown). The stem member is received and mounted in annular recess 134e in smooth fluid communication with passageway 104e. Similarly a nozzle member 202 is provided, mounted in annular recess 208e at the second end of the passageway 104e. Preferably however, the stem member and nozzle member may be integrally formed, such as by molding, with the main body portion of the actuator.

Figure 18A:
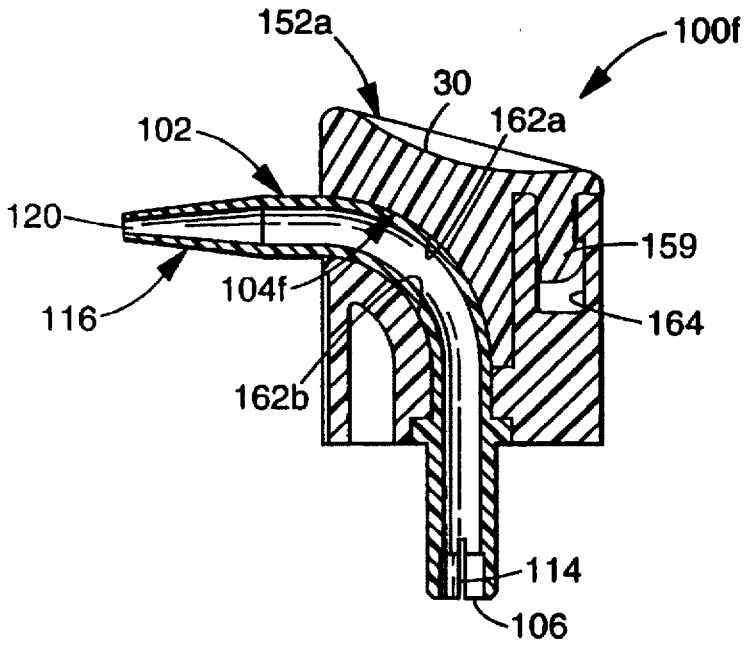
FIG. 18A is a cross sectional view of an alternate embodiment of the actuator of FIG. 18, with a dispensing tube mounted in the passageway.

Another alternate embodiment 100f is shown in FIG. 18A, which is substantially identical to the embodiment shown in FIG. 18. However in the embodiment shown in FIG. 18A, a dispensing tube 102 has been located within the passageway 104f formed by the cap 152a and main body portion.

Figure 19:
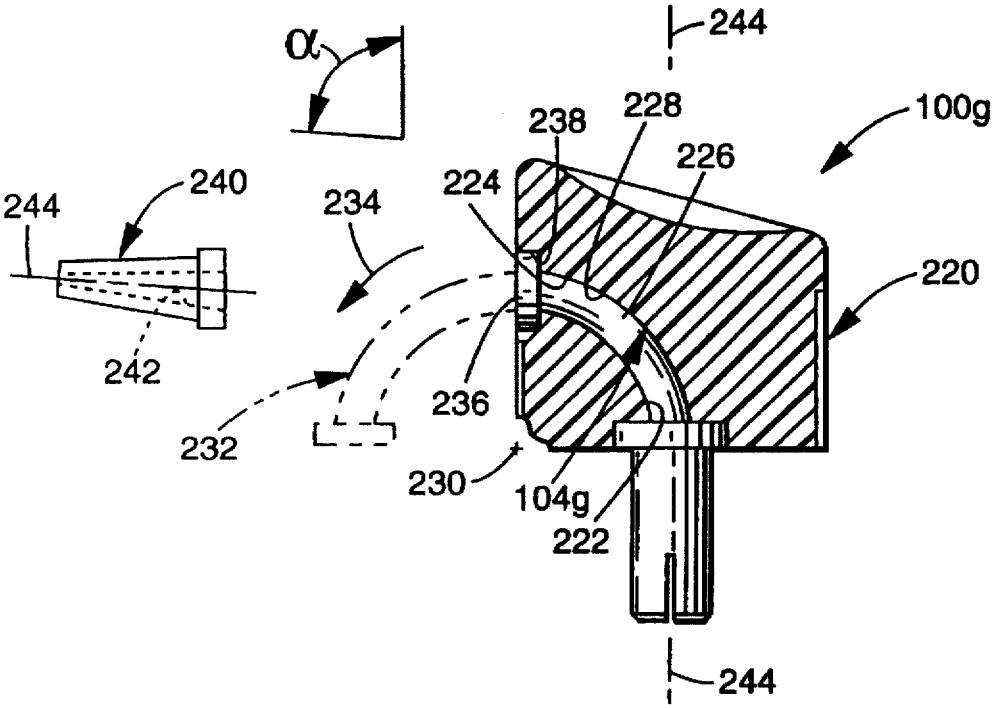
FIG. 19 is a cross sectional view of an alternate embodiment of the present invention with the actuator formed from a unitary molded body with passageway.

Another alternate embodiment 100g of the present invention is illustrated in FIG. 19. In this embodiment, the actuator is formed from a unitary molded body 220, preferably molded from a polymeric material, as previously described herein. As in the embodiments shown in FIGS. 14–16, a passageway 104g is defined within the actuator body, extending from a first end 222 to a second end 224, rather than by a dispensing tube. One method for forming the passageway 104g in a unitary molded body includes providing an arcuate pin 226 in the mold cavity (as at 228). The arcuate pin 226 is rotatable about a center point 230 between a first rotational position (as shown) and a second position (as at 232). The pin 226 is located in the first position when the actuator body is molded. After molding, the pin 226 is rotated within the mold cavity in rotational direction 234 (in a manner known in the art) to the second position, enabling the actuator body to be removed from the mold cavity and forming the passageway. Preferably, the arcuate 226 pin includes a head portion 236 at one end, so that an annular recess 238 is formed at the second end 224 of the passageway. The first end 222 of the passageway may be connected to a stem (not shown) in any suitable manner, previously described herein. Preferably, the stem is integrally molded with the actuator body.

As in the embodiment shown in FIGS. 14–16, a separate nozzle member 240 is provided having a frusto-conical chamber 242 formed therein and adapted for mounting in the annular recess 238 with a smooth transition between the passageway 104g and the frusto-conical chamber 242.

Of course, alternate methods for constructing the actuator body from a unitary molded piece may be employed, such to provide a "sacrificial" mold. That is, a mold is provided with a curvilinear portion occupying the space for the passageway. The actuator body is then molded about the "sacrificial" passageway portion, and the unitary molded actuator body removed from the mold. The "sacrificial" portion is then destroyed to remove it from the actuator body, leaving the passageway free to convey fluid as described elsewhere herein. The "sacrificial" portion may be destroyed by dissolving it in a suitable solvent, melting it, ultrasonically pulverizing it, or any other suitable arrangement.

In the preferred embodiments of the invention that incorporate a separate nozzle member, the nozzle member is constructed and mounted in the annular recess so that the frusto-conical chamber is inclined at an angle et less than 90° with respect to the axis 244. In this manner, any material that solidifies within the frusto-conical chamber 242 tends to be deposited on the "floor" of the chamber and then drains backward through the passageway and back into the reservoir through the actuator. Conventional fluid dispensers have dispensing nozzles that are inclined with respect to the container. Such constructions have been provided to direct the nozzle at a convenient angle for dispensing the fluid from the container but have not addressed the problem of accumulation of solidified material within the nozzle portion or the passageway.

Figure 20A:
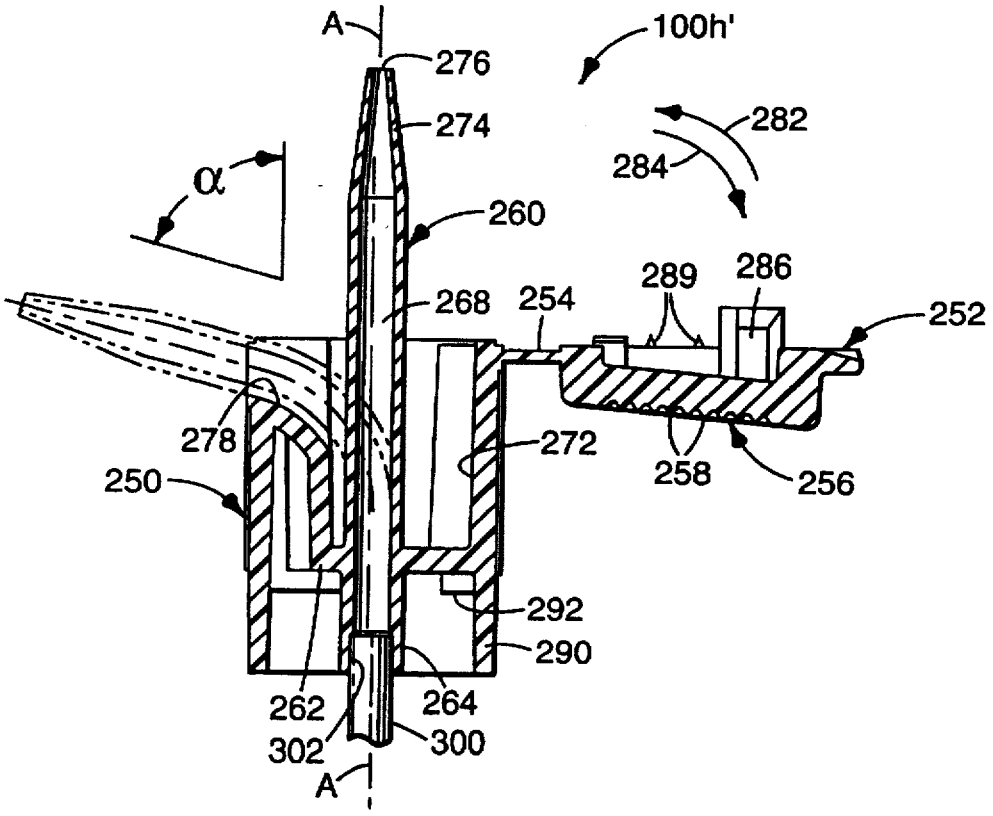
FIG. 20A is a cross-sectional view of the actuator of FIG. 20, modified as a female actuator.
Figure 20:
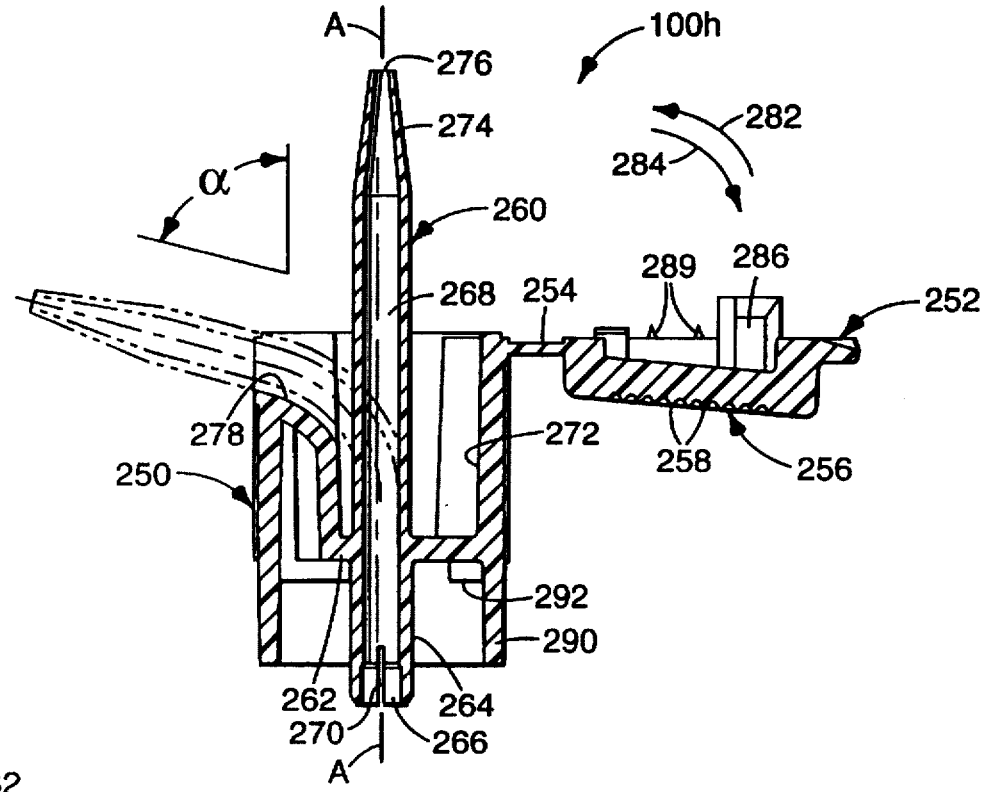
FIG. 20 is a cross sectional view of yet another alternate embodiment of the present invention in which the dispensing tube and the actuator body are formed in a unitary molded structure.
Figure 21A:
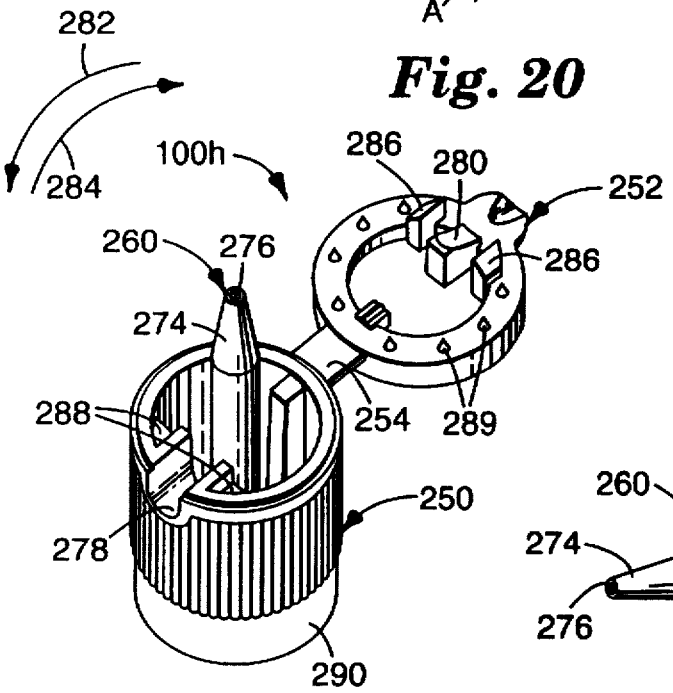
FIG. 21A is an isometric view of the actuator of FIG. 20, with the actuator cap in an open position and the dispensing tube undeflected.
Figure 21B:
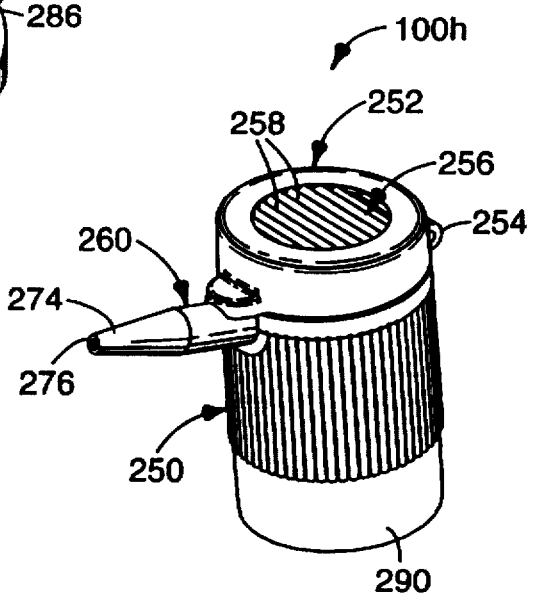
FIG. 21B is an isometric view of the actuator of FIG. 20, with the actuator cap in a closed position and the dispensing tube deflected.

In FIGS. 20, 21A and 21B, there is shown another alternate embodiment 100h of the present invention. In this embodiment, the dispensing tube and the actuator body are formed from a unitary structure, preferably by a molded polymeric material. Any desired molding process may be employed, such as injection molding. Preferably, the embodiment 100h is molded of high density polyethylene, but any suitable material, such as the materials previously discussed herein may be employed, including, but not limited to: polyethylene, polystyrene, polyacrylate, high density polyethylene, polytetrafluoroethylene and nylon.

As shown, the unitary body includes an actuator body 250 and a cap 252 connected to the actuator body, such as by living hinge 254. The top of the cap 252 includes a contact portion 256 adapted for manual engagement to depress the actuator, as previously described. In the illustrated embodiment, the contact surface 256 includes a plurality of parallel fibs 258.

A dispensing tube portion 260 is integrally formed and connected to the actuator body portion 250 by annular flange 262. One end of the dispensing tube portion 260 forms stem 264 for connection to a container and described herein. Opening 266 at the end of the stem communicates with passageway 268 extending through the dispensing tube portion. One or more axially extending slots or slits 270 are formed in the stem and communicate with the opening 266 to regulate the flow of fluid through the passageway 268, previously discussed herein.

The dispensing tube portion 260 extends from annular flange 262 oppositely from stem 264 through cavity 272 in the actuator body. The dispensing tube portion terminates in nozzle 274, which in the illustrated embodiment, is frusto-conical. Passageway 268 terminates in orifice 276 at the tip of the nozzle 274, for directing the flow of fluid from the dispensing tube portion.

As in the embodiments of the present invention previously described herein having a separate dispensing tube, the dispensing tube portion is so constructed as to be smoothly deflectable from the upright, undeflected position shown in FIG. 21A, to the deflected position shown in FIG. 21B. The deflection is accomplished with curvilinear deflecting surface 278 formed on the actuator body portion in the cavity 272. Aligned curvilinear deflecting surface 280 is formed in the facing surface of the cap portion 252. When the cap portion is rotated in direction 282 about hinge 254 to a "closed" position as shown in FIG. 21B, the deflecting surfaces 278, 280 encounter the dispensing tube portion and smoothly deflect it so that the portion protruding from the actuator body is preferably inclined at an angle, with respect to an axis "A" extending though the stem portion of the dispensing tube. The cap portion may be similarly rotated back in direction 284 to the "open" position shown in FIGS. 20 and 21A.

Means are provided to secure the cap portion in the closed position as shown in FIG. 21B. In the illustrated embodiment, the securing means takes the form of a pair of tangs 286 projecting from the facing surface of the cap portion, preferably on either side of the deflecting surface 280. A pair of aligned shoulders 288 are formed in the actuator body, so that when the cap portion is rotated to the closed position, the tangs are interengaged with the shoulders to secure the cap portion in the closed position. The tangs may be forcibly disengaged from the shoulders to enable the cap portion to be rotated back to the open position, if desired. Of course, any other suitable arrangement, such as adhesives, may be employed to secure the cap portion in the closed position, as may be found advantageous in a particular application. Alternatively, if it is found desirable to ultrasonically weld the cap portion to the body portion in the closed position, one or more protrusions or ultrasonic energy directors 289 may be formed in either or both of the facing surfaces of the cap portion and body portion, that are brought into contact with each other when the cap portion is in the closed position. The energy directors facilitate the welding process in a manner known in the art. After ultrasonic welding, the cap portion may not be shifted to the open position, without damage to the actuator.

The illustrated embodiment **100*h* also includes a skirt 290 depending from the actuator body portion. The skirt facilitates guiding the actuator body with respect to a container (not shown) containing a fluid to be dispensed as the actuator is shifted axially. A stop 292 is formed on the actuator body to contact a portion of the container (not shown) to limit downward axial travel of the actuator, thereby limiting transverse movement of the actuator and enabling stability of the actuator and uniform activation during use. It will be appreciated that in all other respects, that embodiment 100*h*** functions as described herein.

FIG. 20A illustrates a modification **100*h*' of the male actuator of the male actuator embodiment of the present invention shown in FIG. 20, as a female actuator. Cavity 300 is formed communicating with opening 266 of passageway 268. Cavity 300 is adapted to relieve in sealing engagement hollow stem 302 extending from a valve (not shown) mounted on a container (similar to the arrangement shown in FIG. 1). In all other respects, the embodiment shown in FIG. 20**A operates as herein described.

In one preferred embodiment of the invention, the nozzle member is constructed of a material (such as polyethylene) that is resilient and has a relatively thin wall. This enables the nozzle to "spit" out globules of fluid having relatively larger diameter, thereby having less tendency to clog.

In order to achieve faster and/or wider coverage, it is sometimes desirable to expel the liquid from the nozzle in a non-circular configuration, such as an oval or fan spray, rather than a circular spray configuration. Inserts or add-on components used to create a non-circular spray must be precisely manufactured and arranged in the spray nozzle to maintain a smooth transition along the passageway to the orifice. Solidified material may accumulate on some mechanisms used to create the fan spray configuration, resulting in potential blockage of the dispenser assembly.

Figure 22A:
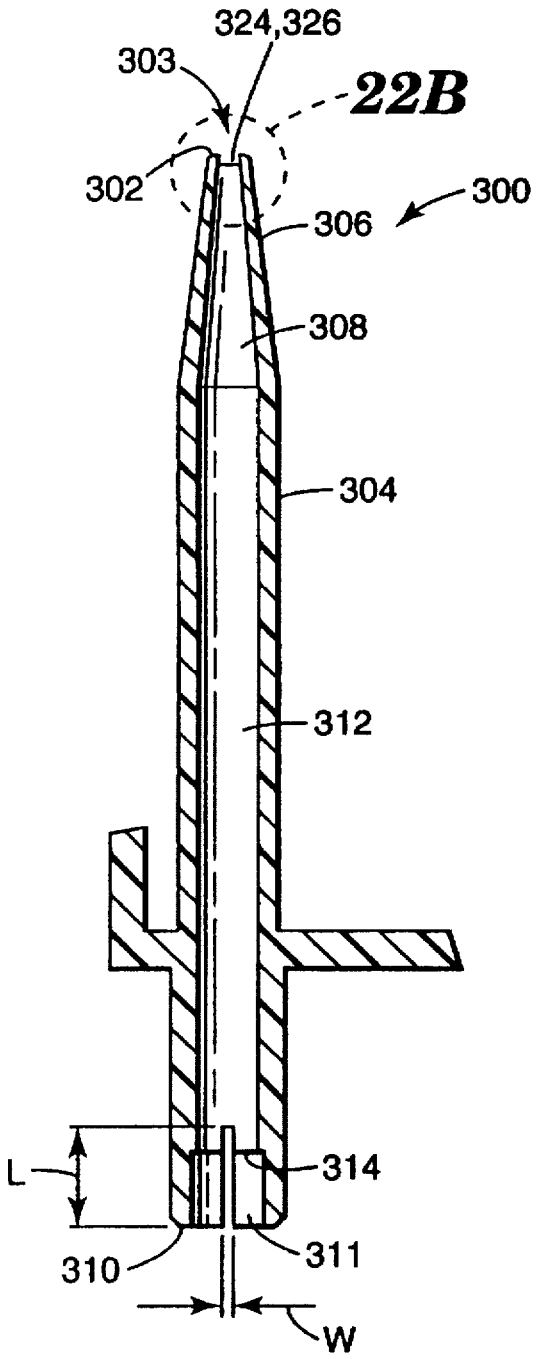
FIG. 22A is a cross sectional view of an integrally formed fan spray assembly located proximate an end of a fluid dispensing tube.
Figure 22B:
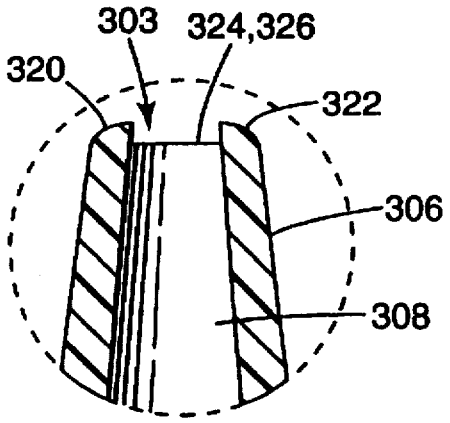
FIG. 22B is a cross sectional view of the outlet end of the dispensing tube of FIG. 22A.
Figure 22C:
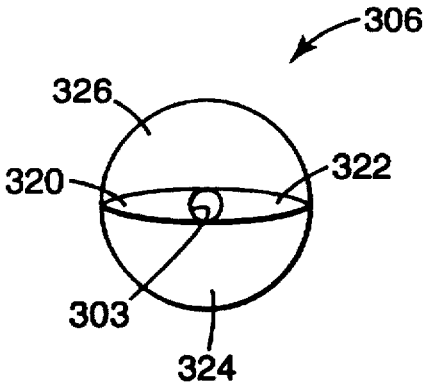
FIG. 22C is a frontal view of the integrally formed fan spray assembly of FIG. 22A.

FIGS. 22A–22C illustrate an integrally formed fan spray assembly 300 located proximate the outlet end 302 of a fluid dispensing tube 304. The integrally formed fan spray assembly 300 minimizes the manufacturing and assembly difficulties of using two or more components to produce a non-circular spray pattern. Additionally, the integral fan spray assembly 300 can be manufactured at a lower cost than some multi-component systems.

Figure 26:
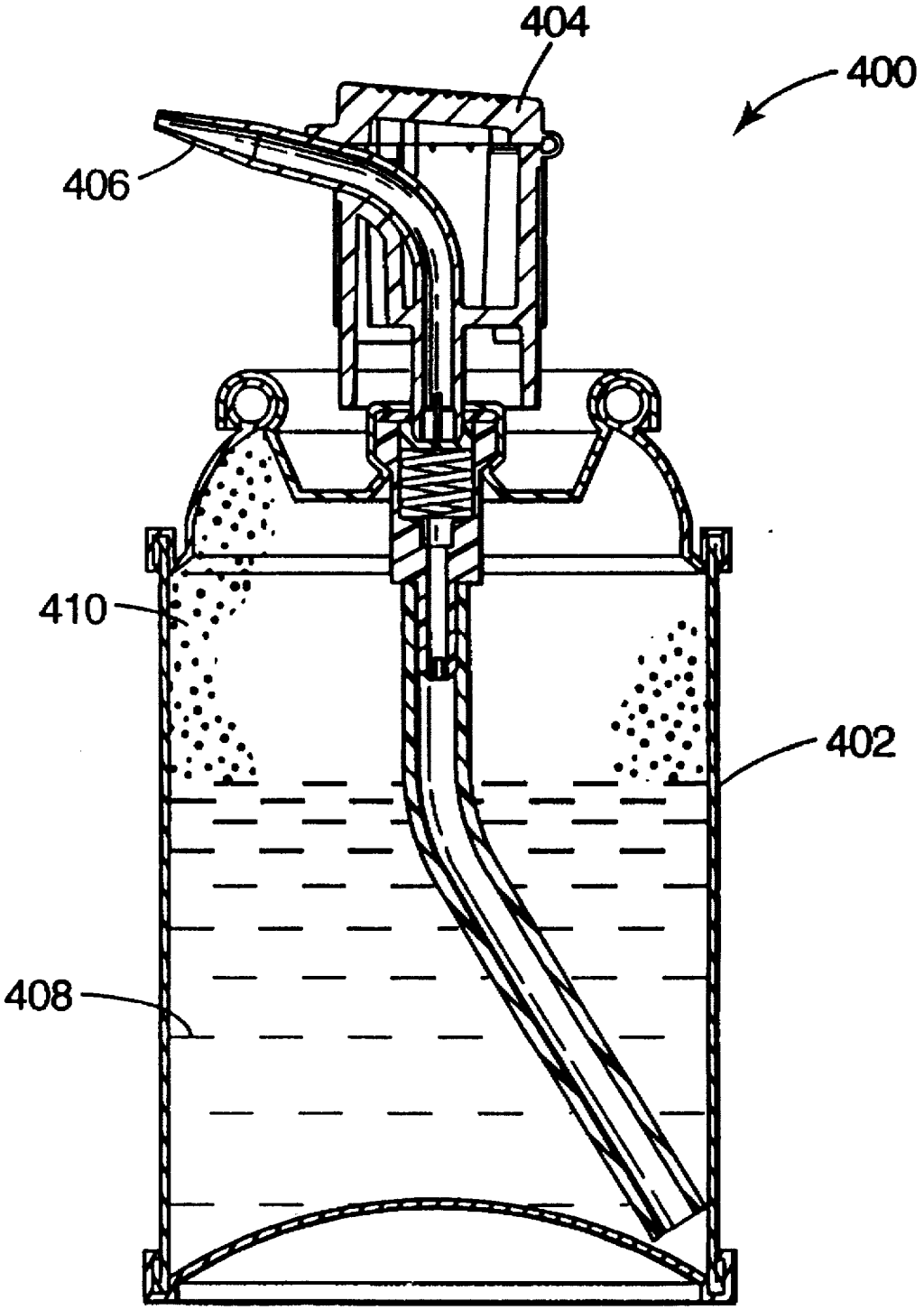
FIG. 26 is a cross-sectional view of an exemplary aerosol spray applicator with a dispensing tube of the present invention.

An inlet end 310 defining an opening 311 is formed in the other end of the dispensing tube 304 for connection to a fluid container (see FIG. 26). The opening 311 communicates with passageway 312 extending through the dispensing tube 304. The passageway has an inside diameter (I.D.) in the range of 1.68 to 4.24 mm (0.066 to 0.167 inches). One or more axially extending slots or slits 314 are formed in the dispensing tube 304 proximate the inlet end 310 that communicate with the passageway 312 to regulate the flow of fluid, as previously discussed herein. The slot length "L" and width "W" defines a flow through area for the fluid. The area defined by the slot 314 determines the flow rate of the fluid through the passageway 312.

The passageway 312 of the dispensing tube 304 terminates at the outlet end 302 in the nozzle portion 306 for directing the flow of fluid from the dispensing tube 304. Nozzle portion 306 includes an inner frusto-conical chamber 308 terminating at an orifice 303. The orifice 303 has an internal diameter (I.D.) generally ranging from 0.46 to 0.66 mm (0.018 to 0.026 inches). This configuration progressively directs the fluid being ejected into a more laminar and coherent flow, thus providing a more controlled and uniform dispersion or spray pattern.

The outlet end 302 includes a pair of opposing, raised deflection surfaces 320, 322. The opposing, raised deflection surfaces are separated by a pair of opposing depressions 324, 326 that create a low pressure condition in a fluid stream ejected from the orifice 303. The low pressure condition causes the fluid stream to fan-out along an axis extending along the orifice 303 and the opposing depressions 324, 326. The aspect ratios of the raised deflection surfaces 320, 322 to the opposing depressions 324, 326 generally determines the aspect ratio of the resulting fan spray. The raised deflection surfaces 320, 322 extend to the outside diameter of the outlet end 302. In the embodiment illustrated in FIG. 22C, the outside diameter of the outlet end 302 is 1.65 mm (0.065 inch). The height differential between the peak elevations of the surfaces 320, 322 and the opposing depressions 324, 326 is approximately 0.35 mm (0.0138 inch). Each of the surfaces 320, 322 has a radius of curvature of approximately 2.6 mm (0.1025 inch) and a width generally corresponding to the inside diameter of the orifice 303. It will be understood that a variety of deflection surface structures are possible to create the low pressure condition necessary to fan-out the fluid during spraying.

As the cross sectional area of the orifice 303 decreases, the velocity of the fluid increases, with a corresponding increase in the fan spray. The increased fan spray reduces the concentration of the fluid in the center spray and increases the aspect ratio of the resulting fan spray. With an orifice having an inner diameter in the range of approximately 0.38–0.41 mm (0.015–0.016 inches), an aspect ratio of the fan spray in the range of 3:1 to 8:1 is expected. It will also be understood that the dimensions of the raised deflection surfaces 320, 322 and/or depressions 324, 326 may be asymmetrical to generate an asymmetrical fan spray.

The dispensing tube 304 may be constructed with a tapered or constant inner diameter throughout its length. Although any of the materials discussed above may be utilized, high density polyethylene is preferred because of its low surface energy properties that minimize adhesion of the fluids. The dispensing tube 304 may be integrally formed and connected to an actuator body, such as is illustrated in FIG. 20, or as a freestanding dispensing tube, such as is illustrated in FIG. 4. The outlet end 302, including the raised deflection surfaces 320, 322 and depressions 324, 326 allow for smooth, fluid communication with the passageway 312 for directing the dispensing of a fluid while attenuating the accumulation of solidified material from the fluid. A surface finish of SPI/SPE #2, free from irregularities, roughness, indentations, projections, protuberances or any abrupt changes in geometry that minimizes locations for the accumulation of solidified material is preferred.

Figure 23:
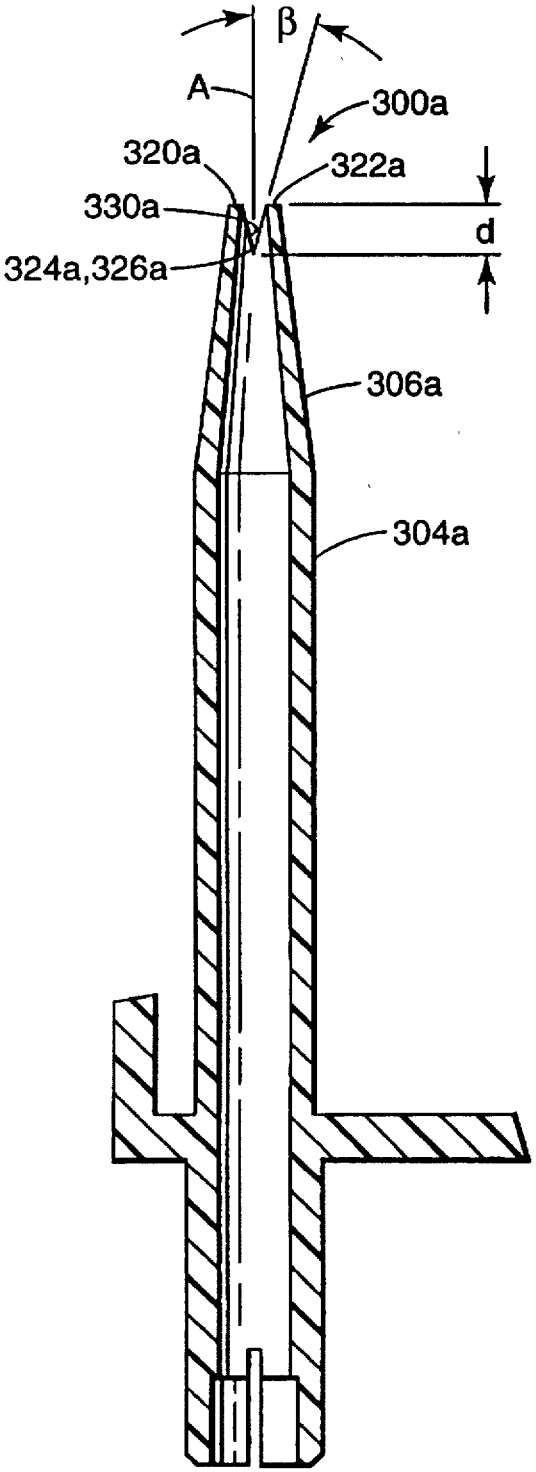
FIG. 23 is a cross sectional view of an alternate fan spray assembly formed in an end of a fluid dispensing tube.

FIG. 23 is a cross sectional view of a dispensing tube **304*a* with an alternate fan spray assembly 300*a* formed proximate nozzle portion 306***a*. A V-shaped trough 330*a* is formed substantially across the outlet end of nozzle portion 306*a* so that the bottom portion of the V intersects an axis "A" defined by the passageway. Top portions of the V-shaped trough 330*a* form opposing, raised deflection surfaces 320*a*, 322*a*. Bottom portions of the V-shaped trough defines depressions 324*a*, 326*a* that create a low pressure condition that causes the fluid stream to fan-out in the direction of the opposing depressions 324*a*, 326*a*.

It will be understood that the depth "d" of the V-shaped 330*a* trough and the angle of the "V" portion can be adjusted to produce the desired aspect ratio of the fan spray. In the preferred embodiments, the depth "d" ranges from 0.28 mm to 1.17 mm (0.011 to 0.046 inches) and the angle β ranges from 15.5–45 degrees. Additionally, the cross-sectional area of the trough 330*a* may alternately be circular, oval, rectangular, or a variety of regular or irregular shapes.

In another embodiment, the sprayability and uniformity may vary due to the viscosity of some water dissolvable and/or dispersable fluids. Consequently, when spraying low viscosity fluids, it may be necessary to mechanically break-up the fluid stream to achieve the desired level of atomization, sprayability and uniformity, without causing the accumulation of solidified material within the passageway of the actuator.

Figure 24:
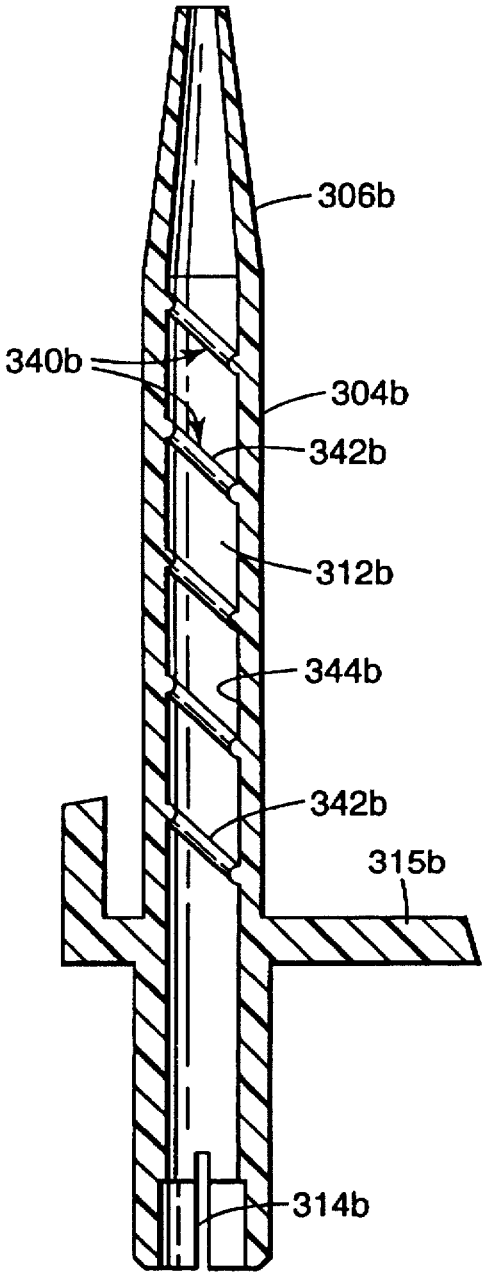
FIG. 24 is a cross sectional view of integrally formed mechanical break-up surfaces formed in a fluid dispensing tube.

FIG. 24 is a cross sectional view of an exemplary dispensing tube 304*b* with integrally formed mechanical break-up surfaces 340*b* located along the passageway 312*b*. The surfaces 340*b* are arranged as two generally concentric spiral ridges 342*b* that extend above the interior surface 344*b* of the passageway 312*b* to create a more turbulent flow of the fluid.

In the exemplary embodiment of FIG. 24, the two spiral ridges 342*b* begin at 90° and 270°, respectively, from slot 314*b*, in a range from approximately 0.254 mm (0.1 inch) above to 0.254 mm below annular flange 315*b*. The spiral ridges each extend 1.25 times around the interior surface 344*b* of the passageway 312*b* to the beginning of the nozzle portion 306*b*. The spiral ridges 342*b* extend approximately 0.08–0.13 mm (0.003–0.005 inch) above the interior surface 344*b* of the passageway 312*b* and have a radius of curvature approximately 0.08 mm (0.003 inches), with smooth transitions with the interior surface 344*b* of the passageway 312*b*. The resulting turbulent flow of the fluid through the dispensing tube 304*b* caused by the spiral ridges 342*b* enhances the mechanical break-up of the fluid for improved sprayability and uniformity.

Figure 25A:
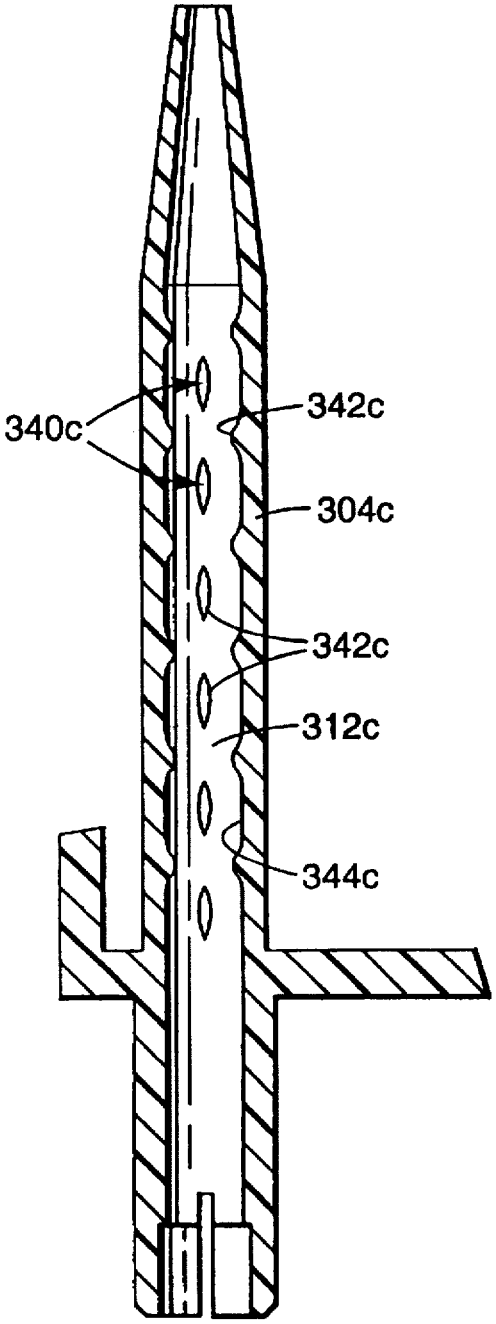
FIG. 25A is a cross sectional view of integrally formed mechanical break-up surfaces formed in a fluid dispensing tube.

FIG. 25A is a cross sectional view of an alternate dispensing tube 304*c* with integrally formed mechanical break-up surfaces 340*c* located along the passageway 312*c*. The break-up surfaces are configured as a plurality of vertically oriented protrusions 342*c*. In one embodiment, the protrusions 342*c* extend approximately 0.064 mm to 0.127 mm (0.0025–0.005 inches) above the interior surface 344*c* of the dispensing tube 304*c*. The intersection of the protrusions 342*c* with the interior surface 344*c* preferably has a radius of curvature of 0.064 mm to 0.127 mm (0.0025–0.005 inches) and a smooth transition back to the interior surface 344*c* of the passageway 312*c*. The protrusions 342*c* may be arranged randomly along the interior surface 344*c* of the passageway 312*c* or in a variety of patterns. For example, in the embodiment illustrated in FIG. 25C, the protrusions 342*e* are arranged in a generally spiral configuration on the interior surface 344*e* of the dispensing tube 304*e*. Alternatively, the protrusions 342*e* may be arranged as a pair of counter-rotating spirals.

It will be understood that the spiral ridges 342*b* and protrusions 342*c*–342*e* are configured to permit smooth, fluid communication with the passageway 312*b*, 312*c*, respectively, and for directing the dispensing of a fluid while attenuating the accumulation of solidified material from the fluid. The ridges 342*b* and protrusions 342*c*–342*e* preferably have a surface finish of SPI/SPE #2, free from irregularities, roughness, indentations, projections, protuberances or any abrupt changes in geometry that provides a location for the accumulation of solidified material.

One method of manufacturing the dispensing tubes of the present invention includes forming indentations corresponding to the spiral ridges or protrusions 342*b*–342*e* on a core used in the injection molding of the dispensing tubes. After the plastic material has solidified, the core is pulled straight out from the dispensing tubes. In the embodiments illustrated in FIGS. 24 and 25C, the core may alternatively be rotated along the spiral ridges 342*b* to facilitate removal.

Figure 25B:
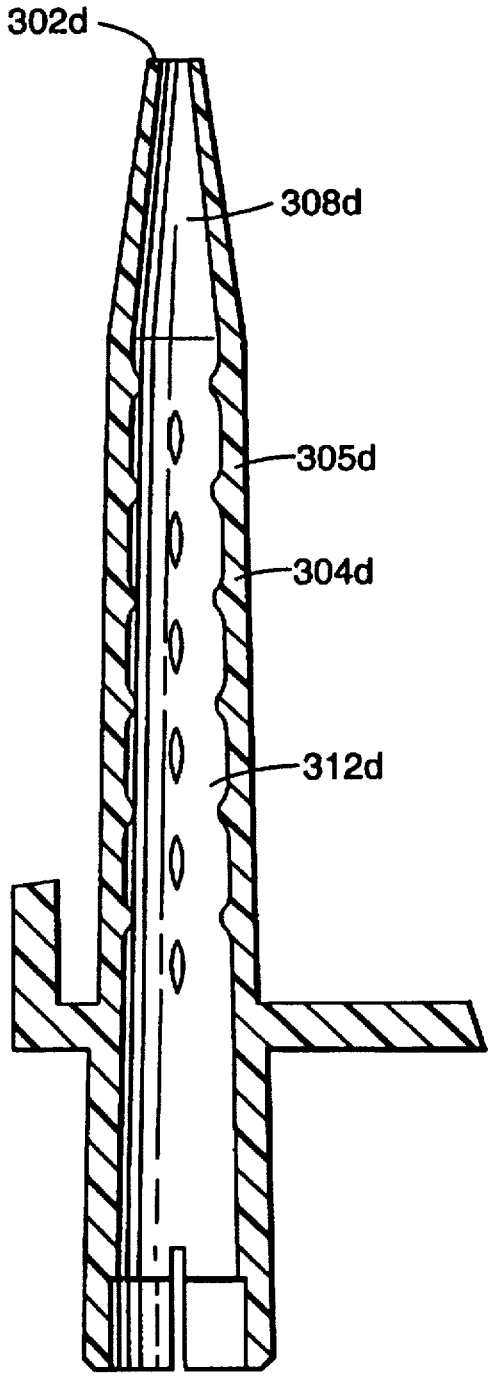
FIG. 25B is a cross sectional view of integrally formed mechanical break-up surfaces formed in a tapered fluid dispensing tube.
Figure 25C:
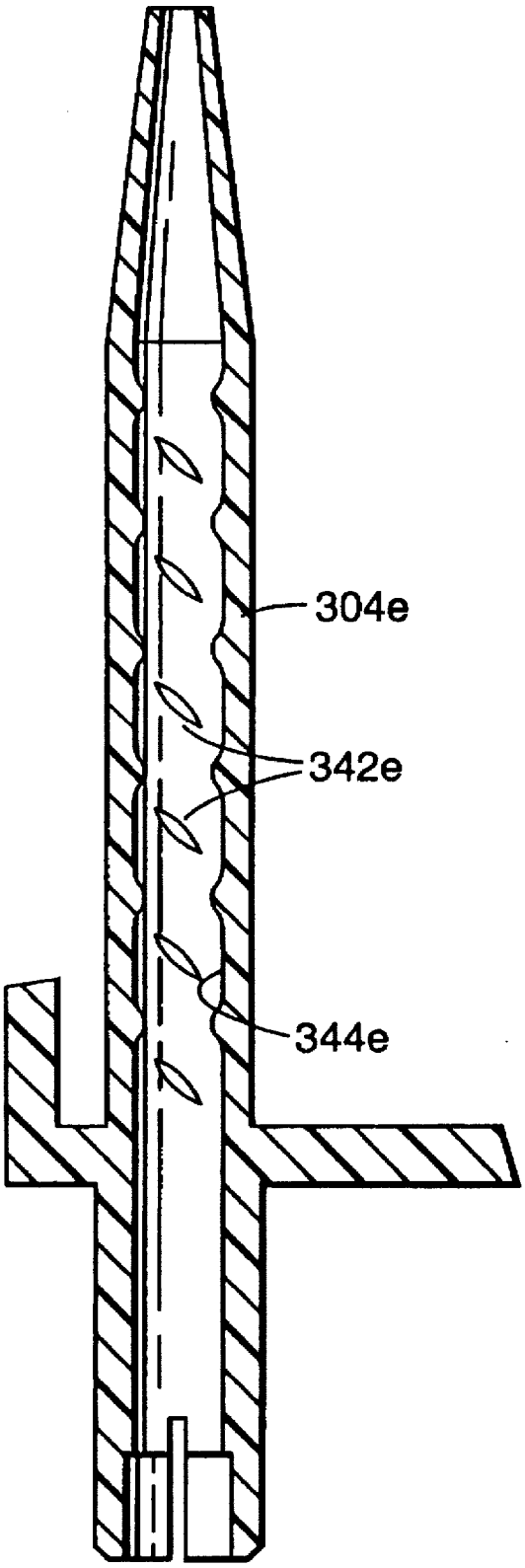
FIG. 25C is a cross sectional view of integrally formed mechanical break-up surfaces arranged in a generally spiral configuration in a fluid dispensing tube.

In an alternate embodiment illustrated in FIG. 25B, passageways 312*d* of dispensing tube 304*d* is configured with a narrowing taper toward the outlet end 302*d* to facilitate removal of the core during manufacturing. In the embodiment illustrated in FIG. 25B, the frusto-conical chamber 308*d* has a greater taper than body portion 305*d* of the dispensing tube 304*d*. Alternatively, the taper of the body portion 305*d* is continuous with the tape of the frusto-conical chamber 308*d*. It will be understood that the various fan spray embodiments may be combined with the mechanical break-up embodiments disclosed herein.

FIG. 26 is an exemplary aerosol spray applicator 400 having a spray head assembly 404 for use with any of the various embodiments of the present dispensing tube 406, such as for example the dispensing tubes illustrated in FIGS. 22–25. A container 402 retains a quantity of fluid 408 under pressure of a propellant 410. It will be understood that the dispensing tube 406 may direct the dispensed fluid 408 in a non-circular spray pattern or into a more turbulent flow, or both as perviously discussed herein.

Spray Width

A container of the material to be tested was secured with a clamp in a vertical position about 20 cm (8 inches) from a drum 41 cm (16 inches) high by 38 cm (15 inches) diameter rotating at 18 RPM, on which a transparent film was attached. Using hand pressure, the container actuator was depressed for about 2 seconds depositing the material on the transparent film. The film was removed from the drum and two measurements of the major dimensions were taken and the average was determined to be the "Spray Width". A desired result is an average spray width of 5.0–10.16 cm (2–4 inches).

Aspect Ratio

A container of the material to be tested was conditioned at room temperature for 24 hours. The contents were then expelled onto a horizontal surface while holding the container at about a 45° angle at a distance of about 15–20 cm (6–8 inches) from the horizontal surface. The actuator was depressed completely and instantly released without laterally moving the container. The pattern expelled was then measured at the longest vertical distance of adhesive deposition and at the widest horizontal distance of adhesive deposition. The vertical measurement was compared to the horizontal measurement to derive the aspect ratio (length:width).

In some instances, the center portion of the spray pattern tended to exaggerate the horizontal measurement, due to high delivery rates. By decreasing the size of the orifice, the velocity of the fluid will increase, causing a reduction in fluid concentration in the center portion and a higher aspect ratio.

Freezing Point Depression

A container of the material to be tested was conditioned at room temperature for 24 hours. The container was then placed into a freezer compartment that was controlled at minus 18 degrees Celsius (0 degrees Fahrenheit) for 24 hours. The container was then removed and conditioned at room temperature for 24 hours. This process was repeated for a total of three freeze-thaw cycles. The tested material was then sprayed to determine uniformity and sprayability of the contained adhesive composition.

Of the two water based formulation tested, Aerosol Formula D was fluid when shaken upon removal from the freezer and exhibited no dimunition of uniformity or sprayability as compared to non-cycled fluid tested at room temperature. Aerosol Formula A, when removed from the freezer compartment was nearly totally solid, even after being conditioned at room temperature. Aerosol Formula A was not sprayable after being subjected to the freeze-thaw cycle.

Delivery Rate

A container of the material to be tested was first weighed (initial weight) and the contents expelled by depressing the spray head for 10 seconds. The container was then weighed again (final weight). The difference between the initial weight and the final weight multiplied by 6 gave the "Delivery Rate" in grams/minute. Delivery rate values are based on at least 10 replicated sprayings for each formulation. The reported ranges encompass at least 90% of the values obtained.

A summary of the delivery rates for various dispensing tube designs, such as illustrated in FIGS. 4, 20 and 22A, are set forth in Table 1 below. The calculated flow-through area of the slot is the slot length minus 1.27 mm (0.05 inches) times the slot width, since the lower portion of the slot is not exposed to the fluid flow. Tests 1 and 2 reflect testing of two different nozzles having the same production specifications.

TABLE 1

| Example | Overall tube length (mm) | Tube I.D. (mm) | Orifice I.D. (mm) | Slot length (mm) | Slot width (mm) | Calculated Area ($mm^2$) | Delivery Rate - Test 1 (g/min) | Delivery Rate - Test 2 (g/min) |
|---|---|---|---|---|---|---|---|---|
| 1 | 34.54 | 1.72 | 0.66 | 2.87 | 0.41 | 0.65 | 100–200 | NT* |
| 2 | 34.54 | 1.70 | 0.56 | 2.87 | 0.36 | 0.57 | 80–90 | NT |
| 3 | 28.55 | 1.68 | 0.51 | 2.83 | 0.39 | 0.62 | 65–90 | 70–85 |
| 4 | 34.54 | 1.70 | 0.56 | 2.79 | 0.36 | 0.54 | 65–85 | 70–80 |
| 5 | 31.75 | 1.70 | 0.64 | 2.82 | 0.31 | 0.47 | 80–85 | NT |
| 6 | 34.54 | 1.70 | 0.56 | 2.79 | 0.36 | 0.54 | 65–85 | NT |
| 7 | 34.54 | 1.70 | 0.61 | 2.79 | 0.23 | 0.35 | 40–50 | NT |
| 8 | 34.54 | 1.70 | 0.56 | 2.77 | 0.41 | 0.61 | 80–90 | NT |
| 9 | 28.55 | 1.68 | 0.51 | 2.74 | 0.38 | 0.56 | 60–80 | 70–80 |
| 10 | 34.54 | 1.70 | 0.56 | 2.67 | 0.36 | 0.50 | 55–65 | 65–80 |
| 11 | 22.86 | 1.68 | 0.43 | 2.65 | 0.40 | 0.55 | 50–80 | 55–65 |
| 12 | 22.86 | 1.68 | 0.43 | 2.63 | 0.31 | 0.41 | 40–60 | NT |
| 13 | 31.75 | 4.24 | 0.46 | 2.56 | 0.36 | 0.46 | 30–50 | NT |

*NT = Not Tested.

Uniformity of Particles/Spray

The material to be tested was sprayed on a substrate. While the material was being sprayed, the sprayed material was visually inspected for uniformity of particles. If at least 90 percent of the spray was of similar size, the spray was observed to be uniform.

Sprayability

A container of the material to be tested was conditioned at room temperature (20 C.) for 24 hours. The contents were then expelled onto a horizontal surface while holding the container at about a 45° angle at a distance of about 15–20 cm (6–8 inches) from the horizontal surface while moving at a rate of about 0.45 m (1.5 ft/second. Spraying was conducted three (3) times per day, five (5) days per week until the contents of the can were evacuated or could no longer be sprayed. Each test was conducted for a 10 second duration. While spraying, observation was made for the occurrence of clogging of the spray nozzle, especially at the outset, and for spitting (large, non-uniform droplets). No spitting or clogging was an acceptable result.

In the following spray formulations, all parts are by weight unless otherwise specified.

Aerosol Formula A—Water Based Formulation

A premix was prepared by blending together 100 parts styrene butadiene rubber (SBR) polymer dispersion, 49% solids (BUTOFAN NS-144, available from BASF Corp., Parsippany, N.J.); 100 parts resin emulsion, 55% solids (FORAL 85-55WKX, available from Hercules, Inc., Wilmington, Del.); and 10 parts antifoam agent (SILWET L-7500, available from Union Carbide Corp., Danbury, Conn.). The premix has a viscosity estimated at about 500 centipoise before addition of the propellant. 70 parts of the premix were filtered through a 100 mesh stainless steel screen and then placed in an empty aerosol can. A Buna rubber gasket and valve (AR-83, available from Seaquist Dispensing, Division of Aptar Group, Cary, Ill.) were inserted and crimped in place. 30 parts of 1,1-difluoroethane propellent (DYMEL 152a, available from E. I. du Pont de Nemours and Co., Wilmington, Del.) were inserted under about 828 kPa (120 psig) up to the desired weight percent. The actuator was added and the can shaken to mix ingredients. Aerosol A thus prepared had a solids content of 38% by weight and a pressure of 586 kPa (85 psig).

Aerosol Formula B—Hydrocarbon Solvent Based Formulation

A premix was prepared by blending together 100 parts crosslinked SBR polymer (POLYSAR S 1018, available from Polysar Ltd, Sarnia, Ontario, Canada), having a gel content of about 81%, containing approximately 23.5% bound styrene, (milled 4 passes through a two roll mill); 60 parts terpene phenolic resin (SCHENECTADY SP-560, available from Schenectady Chemicals, Inc., Rotterdam Junction, N.Y.); 90 parts pentaerythritol ester of hydrogenated resin (FORAL 105, available from Hercules, Inc., Wilmington, Del.); and 465 parts of a mixture of hexane/cyclohexane as solvents. The premix has a viscosity estimated at about 200 centipoise before addition of the propellant. 340 parts of the premix were filtered through a 100 mesh stainless steel screen and then placed in an empty aerosol can. A Buna rubber gasket and valve (AR-83, available from Seaquist Dispensing, Division of Aptar Group, Cary, Ill.) were inserted and crimped in place. 150 parts of a mixture isobutane/propane/dimethyl ether propellent were inserted under about 828 kPa (120 psig) up to the desired weight percent. The actuator was added and the can shaken to mix ingredients. Aerosol B thus prepared had a solids content of 24% by weight and a pressure of 414 kPa (60 psig).

Aerosol Formula C—Hydrocarbon Solvent Based Formulation

A premix was prepared by blending together 100 parts of a copolymer of 95/5 isooctylacrylate/acrylic acid, prepared according to U.S. Pat. No. 3,578,622 (Brown et al., Example 1); 75 parts pentaerythritol ester of hydrogenated resin (FORAL 105, available from Hercules, Inc., Wilmington, Del.); and 1280 parts of 1,1,1-trichloroethane as solvent. The premix has a viscosity estimated at about 10,000 centipoise before addition of the propellant. 250 parts of the premix were filtered through a 100 mesh stainless steel screen and then placed in an empty aerosol can. A Buna rubber gasket and valve (AR-83, available from Seaquist Dispensing, Division of Aptar Group, Cary, Ill.) were inserted and crimped in place. 150 parts of a mixture isobutane/propane propellent were inserted under about 828 kPa (120 psig) up to the desired weight percent. The actuator was added and the can shaken to mix ingredients. Aerosol C thus prepared had a solids content of 7.5% by weight and a pressure of 310 kPa (45 psig).

Aerosol Formula D—Water Based Formulation

A premix was prepared by blending together 400 parts acrylic polymer dispersion, 50% solids (76 RES 9612, from Rohm and Haas Corporation, Philadelphia, Pa.); 200 parts resin emulsion, 55% solids (FORAL 85-55WKX, available from Hercules, Inc., Wilmington, Del.); 13.33 parts resin emulsion (ACRYSOL™ ASE-60 from Rohm and Haas Corporation, Philadelphia, Pa.); 10 parts (CAB-O-SIL™ EH-5 from Cabot Corporation, Tuscola, Ill.); 0.10 parts antifoam additive (FOAMASTER™ B from Henkel Corp., Ambler, Pa.); 10 parts ethylene glycol (from E. I. DuPont de Nemours and Co., Wilmington, Del.); 6.67 parts Morpholine (from Dow Chemical Co., Midland, Mich.); 80 parts ethanol (from Grain Processing, Inc., Muscatine, Iowa); and 310 parts deionized water. The premix thus prepared had a solids content of 30% and had a viscosity of 1800 to 2000 centipoise.

Seventy (70) parts of the premix were filtered through a 100 mesh stainless steel screen and then placed in an empty aluminum aerosol can (from Exal, Inc., Youngstown, OH). A Buna rubber gasket and valve (AR-83, from Seaquist Dispensing, Division of Aptar Group, Cary, Ill.) were inserted and crimped in place. 30 parts of dimethyl ether, DME, propellant (DYMEL™ A from E. I. DuPont de Nemours and Co., Wilmington, Del.) were inserted under about 828 kPa (120 psig) up to the desired weight. The actuator was added and the can shaken to mix ingredients. Aerosol D thus prepared had a solids content of 21% by weight and a pressure of 690 kPa (65 psig). The formulation had a depressed freezing point of minus 18 degrees Celsius (0 degrees Fahrenheit). It was observed in a test glass aerosol container that upon the addition of the DME, the contained material became dramatically more fluid, appearing to have a much lower viscosity.

EXAMPLES OF ACTUATORS

Examples of actuators corresponding to the embodiment 100*a* shown in FIGS. 7 and 8, and 100*h* shown in FIGS. 20, 21A and 21B were constructed and tested according to the test methods described above.

Inventive Example 1

In Example 1 the dispensing tube had an overall length of 3.454 cm (1.360 inches), a slot width between 0.030 and 0.033 cm (0.012–0.013 inches), and a slot height of 0.272 cm (0.107 inches). The dispensing tube had a nominal inner diameter of 0.165 cm (0.065 inches). The frusto-conical chamber of the nozzle portion had a nominal taper of 0.056 RAD. The orifice had a diameter of 0.064 cm (0.025 inches).

Inventive Example 2

All dimensions were as set out in Example 1, except the slot width which was between 0.028 and 0.030 cm (0.011 and 0.012 inches), and the slot height which was 0.267 cm (0.105 inches).

Inventive Example 3

An actuator corresponding to the embodiment 100*h* shown in FIGS. 20, 21A and 21B was constructed of high density polyethylene (Type #9018 available from Chevron Chemical Company, Houston, Tex.) and tested according to the test methods described above.

All dimensions were as set out in Example 1, except the slot height was 0.298 cm (0.1175 inches), and both the interior surface of the dispensing tube and the exterior surface of the nozzle portion were processed to a finish of SPI-SPE#2.

EXAMPLES OF DISPENSING TUBES

Examples of dispensing tubes corresponding to the embodiments shown in FIGS. 22A–25B were constructed and tested according to the test methods described above.

Inventive Example 4

In Example 4 the dispensing tube had an overall length of 34.54 mm (1.360 inches) with a nominal inner diameter of 1.70 mm (0.067 inches). The slot width of 0.36 mm (0.014 inches) and a slot length of 2.79 mm (0.11 inches) provided a calculated flow through area of 0.54 $mm^2$. The orifice had an internal diameter of 0.56 mm (0.022 inches). The configuration produced an oval spray pattern with an aspect ratio (length:width) of 1:1 for Aerosol Formula D and 1.1:1 for Aerosol Formula A.

Inventive Example 5

In Example 5 the dispensing tube had an overall length of 31.75 mm (1.250 inches) with a nominal inner diameter of 1.70 mm (0.067 inches). The slot width of 0.31 mm (0.012 inches) and a slot length of 2.82 mm (0.1112 inches) provided a calculated flow through area of 0.47 $mm^2$. The orifice had an internal diameter of 0.64 mm (0.025 inches). The configuration produced an oval spray pattern with an aspect ratio (length:width) of 1.25:1 for Aerosol Formula D and 1:1 for Aerosol Formula A.

Inventive Examples 6A–6D

In Examples 6, the dispensing tube had an overall length of 34.54 mm (1.360 inches) with a nominal inner diameter of 1.70 mm (0.067 inches). The slot width of 0.41 mm (0.016 inches) and a slot length of 2.77 mm (0.1090 inches) provided a calculated flow through area of 0.61 $mm^2$. The orifice had an internal diameter of 0.56 mm (0.022 inches). Four different V-shaped troughs cut in the outlet end of the dispensing tubes were evaluated to determine the aspect ratios of the resulting fan spray for Aerosol Formulas D and A, as summarized in Table 2 below.

TABLE 2

| Example | Angle β | Trough Depth "d" | Aspect Ratio - Aerosol Formula D | Aspect Ratio - Aerosol Formula A |
|---|---|---|---|---|
| 6A | 45° | 0.28 mm | 2.9:1 | 3.3:1 |
| 6B | 22.5° | 0.28 mm | 1.1:1 | 3.1:1 |
| 6C | 26.6° | 0.64 mm | 5:1 | 5:1 |
| 6D | 15.5° | 1.17 mm | 5.33:1 | 4.4:1 |

Inventive Example 7

In Example 7, the dispensing tube had an overall length of 34.54 mm (1.360 inches) with a nominal inner diameter of 1.70 mm (0.067 inches). The slot width of 0.56 mm (0.022 inches) and a slot length of 2.79 mm (0.11 inches) provided a calculated flow through area of 0.54 $mm^2$. The orifice had an internal diameter of 0.56 mm (0.022 inches). A pair of spiral ridges extending 0.08 mm (0.003 inches) above the interior surface of the passageway were provided, having the configuration described in connection with FIG. 24. The configuration produced a spray pattern with an aspect ratio (length:width) of 1.5:1 for Aerosol Formula D and 1.3:1 for Aerosol Formula A.

Inventive Example 8

In Example 8, the dispensing tube of Example 7 was used except that the slot width was 0.23 mm (0.009 inches), the calculated flow through area was 0.35 $mm^2$ and the orifice had an internal diameter of 0.61 mm (0.024 inches). A pair of spiral ridges extending 0.13 mm (0.005 inches) above the interior surface of the passageway were provided, having the configuration described in connection with FIG. 24. The configuration produced a spray pattern with an aspect ratio (length:width) of 1.2:1 for Aerosol Formula D and 1.2:1 for Aerosol Formula A.

Inventive Example 9

In Example 9, a dispensing tube with a V-shaped trough was combined with the spiral ridges of Example 8. The dispensing tube had an overall length of 34.54 mm (1.360 inches) with a nominal inner diameter of 1.70 mm (0.067 inches). The slot width of 0.23 mm (0.009 inches) and a slot length of 2.79 mm (0.11 inches) provided a calculated flow through area of 0.35 $mm^2$. The orifice had an internal diameter of 0.46 mm (0.018 inches). A pair of spiral ridges extending 0.13 mm (0.005 inches) above the interior surface of the passageway were provided, such as is illustrated in FIG. 24. The V-shaped trough has an angle β of 45° and a depth "d" of 0.28 mm (0.011 inches). The configuration produced a spray pattern with an aspect ratio (length:width) of 4.7:1 for Aerosol Formula D and 3:1 for Aerosol Formula A.

Inventive Example 10

In Example 10, a dispensing tube with a plurality of protrusions on the interior surface of the passageway. The dispensing tube had an overall length of 31.44 mm (1.238 inches) with a nominal inner diameter of 1.70 mm (0.067 inches). The slot width of 0.36 mm (0.014 inches) and a slot length of 2.55 mm (0.1005 inches) provided a calculated flow through area of 0.46 $mm^2$. The orifice had an internal diameter of 0.46 mm (0.018 inches). A plurality of protrusions extending 0.13 mm (0.005 inches) above the interior surface of the passageway were provided, such as is illustrated in FIGS. 25A–B. The configuration produced a spray pattern with an aspect ratio (length:width) of 1.25:1 for Aerosol Formula D and 1.3:1 for Aerosol Formula A.

Conventional Example 1

A 152-20-18-10 actuator having a slot width of 0.051 cm (0.020 inches), available from Newman-Green, Addison, Ill., was used.

Conventional Example 2

An 820-20-23N Seaquist Brand actuator having a slot width of 0.051 cm (0.020 inches), available from Seaquist Dispensing, Division of Aptar Group, Cary, Ill., was used.

Conventional Example 3

A 120-24-18-10 actuator having a slot width of 0.051 cm (0.020 inches) available from Lindal Valve, GmbH, Germany, was used.

A summary of the uniformity and sprayability of various formulations and actuators are given in Table 3 below.

TABLE 3

| Actuator | Aerosol Formula | Delivery Rate (g/min) | Spray Width (cm) | Uniformity | Sprayability |
|---|---|---|---|---|---|
| Inv. Ex. 1 | A | 86 | 9.65 | Uniform | Acceptable |
| Inv. Ex. 1 | A | 90 | 7.62 | Uniform | Acceptable |
| Inv. Ex. 2 | A | 45–50 | 6.35 | Uniform | Acceptable |
| Inv. Ex. 1 | B | 72 | 6.35 | Uniform | Acceptable |
| Inv. Ex. 1 | C | 52 | 7.62 | Uniform | Acceptable |
| Inv. Ex. 3 | A | 93 | 9.52 | Uniform | Acceptable |
| Conv. Ex. 1 | A | 67 | 6.35 | Uniform | Unacceptable |
| Conv. Ex. 2 | B | 77 | 5.08 | Uniform | Unacceptable |
| Conv. Ex. 3 | C | 62 | 4.83 | Nonuniform | Unacceptable |

It can be seen from the above data that by reducing the slot width and slot length of the actuator, the delivery rate can be reduced. It can also be seen from the above data that the present invention allows for acceptable sprayability and particle uniformity of a water-based adhesive formulation, while conventional actuators do not.

In regard to all of the embodiments of the present invention described hereinabove, it is believed that the preferred range of inclination (α) is between 0°–20°, for optimal operation.

A summary of formulations, dispensing tubes, and aspect ratio are given in Table 4 below. While the specifications of the dispensing tubes in Table 4 correspond to those in inventive examples 5–9, the actual dispensing tubes used to perform the test were subject to manufacturing variation, which accounts for the variability in some of the data.

TABLE 4

| Dispensing tube example | Aerosol Formula | Delivery Rate (g/min) | Aspect Ratio | Uniformity | Sprayability |
|---|---|---|---|---|---|
| Inv. Ex. 5 | D | 80–85 | 1.25:1 | Nonuniform | Unacceptable |
| Inv. Ex. 5 | A | 80–85 | 1:1 | Uniform | Acceptable |
| Inv. Ex. 6A | D | 80–90 | 2.9:1 | Nonuniform | Unacceptable |
| Inv. Ex. 6A | A | 80–90 | 3.3:1 | Uniform | Acceptable |
| Inv. Ex. 6D | D | 80–90 | 5.3:1 | Nonuniform | Acceptable |
| Inv. Ex. 6D | A | 80–90 | 4.4:1 | Uniform | Unacceptable |
| Inv. Ex. 8 | D | 40–50 | 1.2:1 | Uniform | Acceptable |
| Inv. Ex. 8 | A | 40–50 | 1.2:1 | Uniform | Acceptable |
| Inv. Ex. 9 | D | 40–50 | 4.7:1 | Uniform | Acceptable |
| Inv. Ex. 9 | A | 40–50 | 1.2:1 | Nonuniform | Unacceptable |

The present invention has now been described with reference to multiple embodiments thereof. It will be apparent to those skilled in the art that many changes can be made in the embodiments described without departing from the scope of the present invention. For instance, it is within the spirit and scope of the invention to provide an actuator that is rotated between open and closed positions, rather than axially shifted as illustrated herein. Further, the actuator, dispensing tube and other components of the present invention may be constructed from other materials, such as metallic materials including, but not limited to, aluminum and a copper-beryllium alloy; ceramic materials, and thermoset resins, as may be found advantageous. Such materials may be useful in dispensing fluids that have been heated to an elevated temperature. Thus, the scope of the present invention should not be limited to the structures described in this application, but only by structures described by the language of the claims and the equivalents of those structures.

What is claimed:

1. A dispensing tube engageable with an actuator body for directing the dispensing of fluids, comprising:

a dispensing tube capable of being deflected by the actuator body when engaged therewith to define a passageway smoothly extending through the actuator body in a smooth curvilinear manner from an inlet end to an outlet end for conveying the fluid from the inlet end to the outlet end thereof while attenuating accumulation of solidified material from the fluid within the passageway and on an external surface of the dispensing tube proximate the outlet end, and fluid deflection means integrally formed in the dispensing tube in smooth fluid communication with the passageway for directing the dispensing of a fluid while attenuating the accumulation of solidified material from the fluid on the fluid deflection means.

2. The apparatus of claim 1 wherein the fluid deflection means comprises at least one deflecting surface formed proximate the outlet end of the dispensing tube for directing the dispensing of fluid to produce a non-circular spray pattern.

3. The apparatus of claim 2 wherein the fluid deflection means further comprises at least one raised surface on an interior surface of the passageway for directing the fluid into a more turbulent flow.

4. The apparatus of claim 1 wherein the fluid deflection means comprises a shaped trough cut in the outlet end of the dispensing tube intersecting and generally perpendicular to an axis defined by the passageway.

5. The apparatus of claim 1 wherein the fluid deflection means directs the dispensing of a fluid in a non-circular spray pattern with an aspect ratio of between 3:1 to 8:1.

6. The apparatus of claim 1 wherein the fluid deflection means comprises at least one deflecting surface formed proximate the outlet end of the dispensing tube for directing the dispensing of fluid to produce a generally elongated oval fan spray pattern.

7. The dispensing tube of claim 1 mounted on a container having a reservoir for receipt of a quantity of the fluid, the dispensing tube being in fluid communication with the fluid within the reservoir, further including means for propelling the fluid from the reservoir through the passageway of the dispensing tube.

8. The dispensing tube of claim 7 further including a quantity of fluid in the reservoir of the container.

9. The article of claim 1 wherein the dispensing tube and the actuator body comprise a unitary, molded body.

10. A dispensing tube engageable with an actuator body for directing the dispensing of fluids, comprising:

a dispensing tube capable of being deflected by the actuator body when engaged therewith to define a passageway smoothly extending through the actuator body in a smooth curvilinear manner from an inlet end to an outlet end for conveying the fluid from the inlet end to the outlet end thereof while attenuating accumulation of solidified material from the fluid within the passageway and on an external surface of the dispensing tube proximate the outlet end; and at least one deflecting surface integrally formed in the dispensing tube in smooth fluid communication with the passageway for directing the dispensing of a fluid to produce a non-circular spray pattern while attenuating the accumulation of solidified material from the fluid on the fluid deflection means.

11. The apparatus of claim 10 wherein the at least one deflection surface comprises a pair of opposing deflection surfaces formed on the external surface of the dispensing tube adjacent to the outlet end.

12. The apparatus of claim 10 wherein the at least one fluid deflecting surface comprises a shaped trough cut in the outlet end of the dispensing tube intersecting and generally perpendicular to an axis defined by the passageway.

13. The apparatus of claim 12 wherein the shape trough comprises a V-shaped trough.

14. The apparatus of claim 13 wherein the V-shaped trough defines an angle of about 15 to 45 degrees.

15. The apparatus of claim 12 wherein the shaped trough directs the dispensing fluid to produce a non-circular spray pattern.

16. The apparatus of claim 12 wherein the shaped trough extends through the external surface of the dispensing tube.

17. The apparatus of claim 10 further including at least one raised surface on an interior surface of the passageway for directing the fluid into a more turbulent flow.

18. The dispensing tube of claim 10 mounted on a container having a reservoir for receipt of a quantity of the fluid, the dispensing tube being in fluid communication with the fluid within the reservoir, further including means for propelling the fluid from the reservoir through the passageway of the dispensing tube.

19. The dispensing tube of claim 18 further including a quantity of fluid in the reservoir of the container.

20. The apparatus of claim 10 wherein the non-circular spray pattern comprises a generally elongated oval fan spray pattern.

21. The article of claim 10 wherein the dispensing tube and the actuator body comprise a unitary, molded body.

22. A dispensing tube engageable with an actuator body for directing the dispensing of fluids, comprising:

a dispensing tube capable of being deflected by the actuator body when engaged therewith to define a passageway smoothly extending through the actuator body in a smooth curvilinear manner from an inlet end to an outlet end for conveying the fluid from the inlet end to the outlet end thereof while attenuating accumulation of solidified material from the fluid within the passageway and on an external surface of the dispensing tube proximate the outlet end; and at least one raised surface integrally formed on an interior surface of the passageway of the dispensing tube in smooth fluid communication with the passageway for directing the dispensing of a fluid into a more turbulent flow while attenuating the accumulation of solidified material from the fluid on the fluid deflection means.

23. The article of claim 22 wherein the dispensing tube and the actuator body comprise a unitary, molded body.

24. The apparatus of claim 22 wherein the passageway comprises a generally tapered passageway narrowing toward the outlet end.

25. The apparatus of claim 22 further including at least one deflecting surface integrally formed in the dispensing tube proximate the outlet end of the dispensing tube for directing the dispensing of fluid in a non-circular spray pattern.

26. The apparatus of claim 25 wherein the at least one deflecting surface comprises a shaped trough cut in the outlet end of the dispensing tube intersecting and generally perpendicular to an axis defined by the passageway.

27. The apparatus of claim 26 wherein the shape trough comprises a V-shaped trough.

28. The dispensing tube of claim 22 mounted on a container having a reservoir for receipt of a quantity of the fluid, the dispensing tube being in fluid communication with the fluid within the reservoir, further including means for propelling the fluid from the reservoir through the passageway of the dispensing tube.

29. The apparatus of claim 22 wherein the at least one raised surface comprises a spiral configuration.

30. The dispensing tube of claim 29 further including a quantity of fluid in the reservoir of the container.

31. The apparatus of claim 22 wherein the at least one raised surface comprises a plurality of protrusions.

32. The apparatus of claim 31 wherein the plurality of protrusions are arranged in a generally spiral configuration.

33. An actuator for use with a dispenser for a fluid, comprising:

an actuator body;

a passageway smoothly extending in a smooth curvilinear manner through the actuator body from an inlet end to an outlet end, for conveying the fluid from the inlet end to the outlet end thereof while attenuating accumulation of solidified material from the fluid within the passageway and on the actuator body;

a dispensing tube having an inlet end and an outlet end defining the passageway extending between the inlet end and the outlet end of the dispensing tube;

fluid deflection means integrally formed in the dispensing tube in smooth fluid communication with the passageway for directing the dispensing of a fluid while attenuating the accumulation of solidified material from the fluid on the fluid deflection means;

means for mounting the dispensing tube on the actuator body; and means for deflecting a portion of the dispensing tube while received mounted on the actuator body, wherein the passageway extends smoothly in a curvilinear manner between the inlet end and the outlet end to attenuate the accumulation of solidified material from the fluid during dispensing of the fluid.

* * * * *